US006086062A

United States Patent [19]

Nakamura et al.

[11] Patent Number: 6,086,062

[45] Date of Patent: Jul. 11, 2000

[54] SHEET FEEDER UNIT

[75] Inventors: Yasuo Nakamura, Toyokawa; Haruhiko Hori, Okazaki, both of Japan

[73] Assignee: Minolta Co., Ltd., Osaka, Japan

[21] Appl. No.: 08/995,579

[22] Filed: Dec. 22, 1997

[30] Foreign Application Priority Data

| | | | |
|---|---|---|---|
| Dec. 25, 1996 | [JP] | Japan | 8-346010 |
| Dec. 25, 1996 | [JP] | Japan | 8-346013 |
| Dec. 25, 1996 | [JP] | Japan | 8-346014 |
| Dec. 25, 1996 | [JP] | Japan | 8-346015 |
| Dec. 25, 1996 | [JP] | Japan | 8-346016 |
| Dec. 25, 1996 | [JP] | Japan | 8-346017 |
| Dec. 25, 1996 | [JP] | Japan | 8-346019 |

[51] Int. Cl.[7] ..... B65H 3/52

[52] U.S. Cl. ..... 271/121

[58] Field of Search ..... 271/121, 124, 271/125, 167, 171

[56] References Cited

U.S. PATENT DOCUMENTS

| | | | |
|---|---|---|---|
| 5,026,042 | 6/1991 | Miller | 271/121 X |
| 5,537,227 | 7/1996 | Samii et al. | 271/121 X |

FOREIGN PATENT DOCUMENTS

| | | | |
|---|---|---|---|
| 0694490 | 1/1996 | European Pat. Off. . | |
| 0694491 | 1/1996 | European Pat. Off. . | |
| 0697358 | 2/1996 | European Pat. Off. . | |
| 543075 | 2/1993 | Japan | 271/121 |
| 7-196186 | 8/1995 | Japan . | |

*Primary Examiner*—David H. Bollinger
*Attorney, Agent, or Firm*—Sidley & Austin

[57] ABSTRACT

A sheet feeder unit capable of separately supplying cut sheets of any thickness or characteristics without causing any residual deformation. The pile of cut sheets 11 are advanced one by one with a pair of feeding rollers 31 contacting thereto from one side thereof. A friction member 33 of various configurations is disposed at various positions for separating the outermost cut sheet 11 from the other sheets by the frictional force of contact generated therebetween when the friction member is backed away by the advancing cut sheet 11.

31 Claims, 34 Drawing Sheets

SHEET FEEDER UNIT

BACKGROUND OF THE INVENTION

1. Technical Field of the Invention

This application is based on applications Nos. 8-346010, 8-346013, 8-346014, 8-346015, 8-346016, 8-346017, and 8-346019 filed in Japan, the contents of which are hereby incorporated by reference.

The present invention relates to a sheet feeder unit which supplies cut sheets set in a pile thereon by a feeding roller which contacts to the cut sheets from one side thereof, and particularly to a sheet feeder unit which is capable of separating cut sheets to be supplied one after another by a frictional force generated when a leading end of the cut sheet is pushed forward to contact with a friction member which is supported at one end thereof and extended toward a conveying path of the cut sheet. The present invention may be employed for feeding a plurality of piled cut sheets one by one in various appliances such as a copying machine, printer, facsimile machine, or image reading apparatus.

2. Description of Related Art

Japanese published unexamined patent application No. 7-196186 discloses the like of such sheet feeder unit, which is shown in FIG. 1. The feeder unit according to this prior art has a friction member 933 rotatably supported at its lower end by a shaft 932 to be able to stand upright and tilt, and configured to be rectangular when viewed from the front. Each time a feeding roller 931 is rotated, an uppermost cut sheet 911 is pushed forward so that a whole width of a leading end of the cut sheet 911 comes into frictional contact with the friction member 933 and causes the same to back away against a rebounding force of a spring 934 as shown by phantom lines in FIG. 1. The cut sheet 911 is thereby separated from the other cut sheets, which are prevented from being supplied one upon another.

In order to assure the separation of cut sheets from each other, the angle $\alpha$ made by a surface of the friction member 933 and an uppermost cut sheet 911 is set within the range of 55° to 85°. The above mentioned published application also teaches a friction member made of an elastic sheet and fixed at its lower end with the same angular condition as described above, instead of being rotatably supported by the shaft 932.

The friction member of such configuration, however, requires a very fine adjustment to successfully separate the cut sheets. According to an experiment conducted by the inventors of the present invention, the rebounding force of the spring 934 toward its initial position should be set weak enough to prevent residual deformation of the cut sheet caused by the friction member 933. On the other hand, the rebounding force should be strong enough to increase the frictional force between the cut sheet 911 and the friction member 933 so as to ensure the separation. It is difficult to satisfy both of these contradictory conditions. Moreover, physical properties of cut sheets such as resiliency or frictional coefficient vary depending on their quality and thickness, causing differences in frictional resistance even with the use of the same friction member.

Also, the friction member 933 in this prior art arrangement is disposed downstream in a feeding direction and away from a nipping position where the feeding roller 931 presses and pushes the cut sheet 911 forward. The cut sheet is, when contacted against the friction member 933, warped and separated from the other cut sheets. Since the friction member 933 is distanced from the feeding roller 931 widely enough to allow the cut sheet 911 to flexibly deform therebetween, the cut sheet 911 can easily escape from the friction member 933 which is being tilted backward. This configuration helps to prevent residual deformation of the cut sheets 911 irrespective of their thickness.

Still, the sheet feeder unit of this prior art is not fully capable of stably separating cut sheets 911 and sometimes supplies the cut sheets in plural one upon another for the following reason. Since the friction member 933 has an even surface against which the cut sheet 911 is contacted, the more the leading end of the cut sheet 911 pushes the friction member 933 and approaches a free end thereof, the more the contacting angle therebetween widens, to let the cut sheet 911 pass, causing the frictional force to become less than a desired degree. Multiple cut sheets 911 may thus slip through the friction member 933 from time to time without being fully separated from each other. Although the setting of the angle between the cut sheet 911 and the friction member 933 helps prevent such slippage to some extent, it is not enough to fully prevent faulty feeding of cut sheets, especially those being less resilient or having a greater frictional coefficient due to their quality or thickness.

The conditions required for successfully feeding sheets may be satisfactorily set, though it is only temporary as the sheet feeding performance is dependent on various ambient conditions. For example, a cut sheet made of paper which has high absorbency may be less smoothly conveyed. An unabsorbent cut sheet made of synthetic resin for an overhead projector may be also affected by humidity on its surface, which may cause the cut sheet to be fed one upon another. Even the fiber directions (whether parallel or right-angled with respect to the sheet feeding direction) of manufactured paper may slightly affect the resiliency of the cut sheet, causing instability in sheet feeding performance.

Further, the friction member 933 of the prior art apparatus has an even friction surface with respect to a whole width of the leading edge of the cut sheet 911 contacted thereto. For this reason, when the conditions are set to provide enough frictional force in order to fully separate cut sheets of small size, cut sheets of greater size cannot be smoothly fed because of too much frictional force. On the other hand, when the conditions are set appropriately for feeding cut sheets of great size, cut sheets of small size may be fed one upon another due to insufficient frictional force.

Further, when a cut sheet having its leading edge curled downwardly is fed, it is more likely that the cut sheet is curled even more when pushed against the friction member 933 because of its even frictional surface in the prior art arrangement, which can leads to a paper jam or cause the cut sheet to be crumpled or stuck to the following sheets.

BRIEF SUMMARY OF THE INVENTION

In view of the foregoing, it is a primary object of the present invention to provide a sheet feeder unit being capable of successfully separating and supplying cut sheets of any thickness or physical properties.

Other and further objects, features and advantages of the invention will appear more fully from the following description.

BRIEF DESCRIPTION OF THE DRAWINGS

FIGS. 5A–5C are explanatory views for theoretically explaining the separation of cut sheets by the friction member according to the present invention, in which FIG. 5A is a sectional view, FIG. 5B is a graph showing a boundary condition whether the cut sheet stops or proceeds when contacted against the friction member, and FIG. 5C is a conceptualistic view showing the way how the cut sheets are loosened with the friction member;

DETAILED DESCRIPTION OF THE INVENTION

Preferred embodiments of the present invention will be hereinafter described in conjunction with the accompanying drawings.

<First Embodiment>

Figure 2:
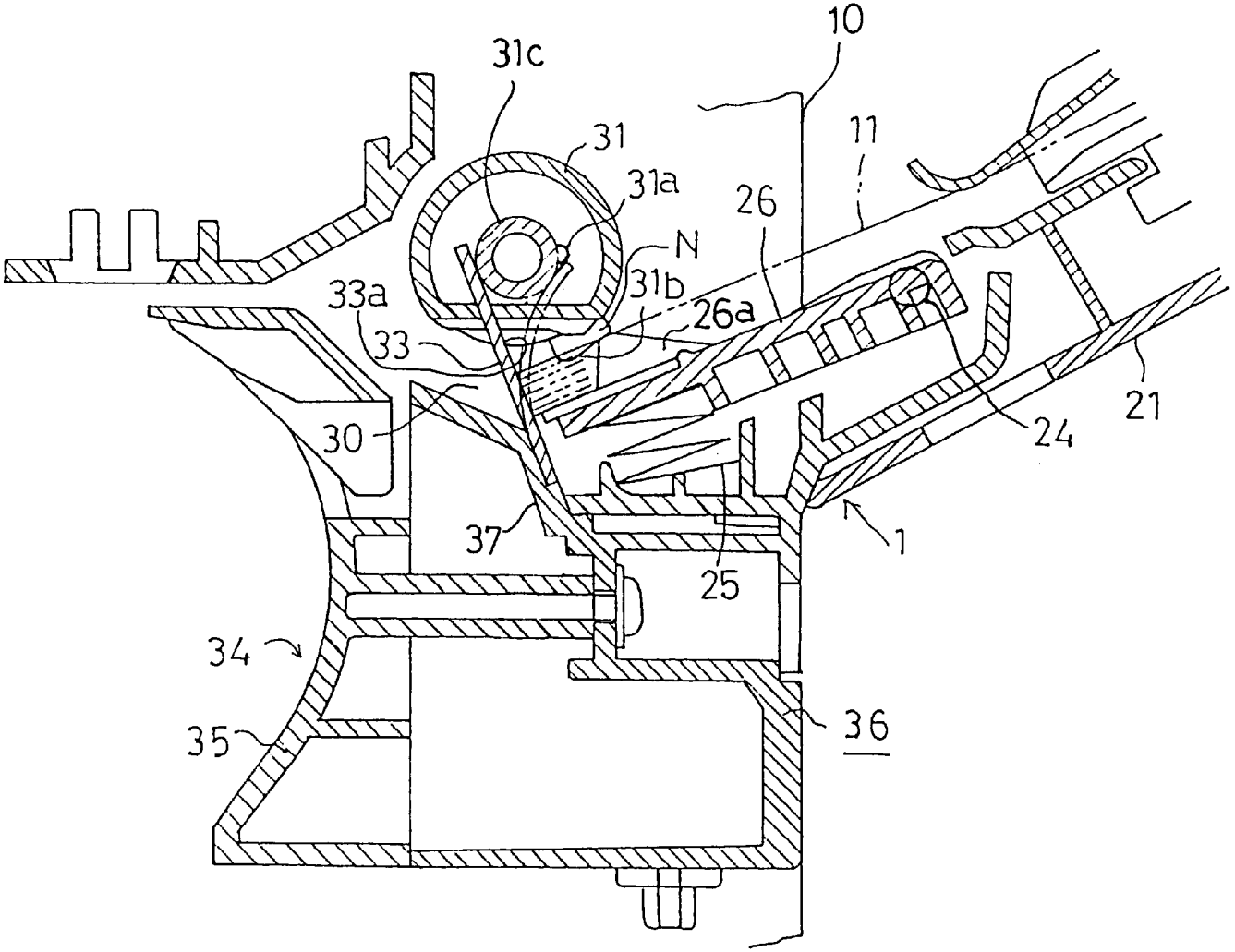
FIG. 2 is a sectional view showing primary parts of a sheet feeder unit according to a first embodiment of the present invention.
Figure 3:
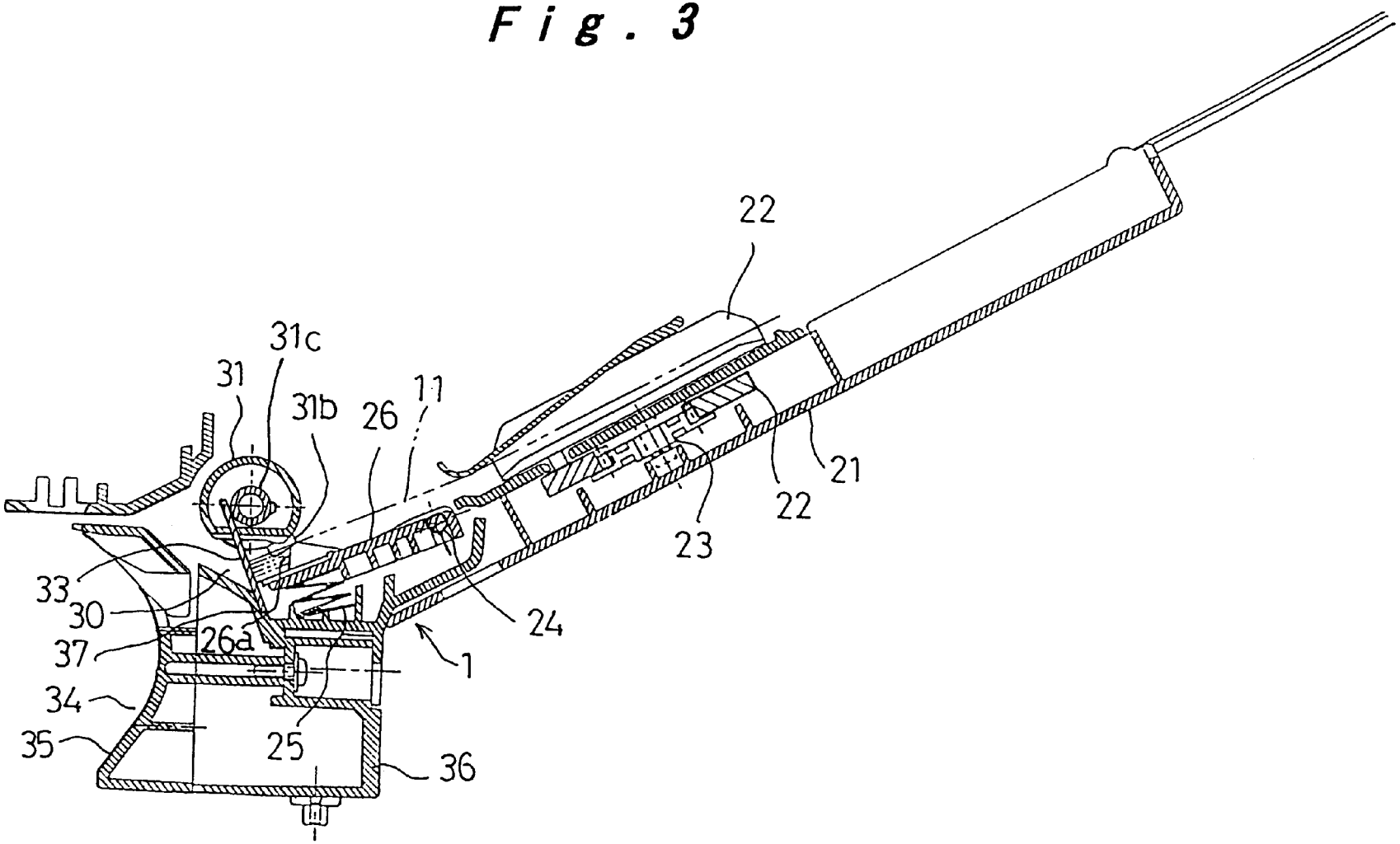
FIG. 3 is a sectional view of an entire body of the sheet feeder unit of FIG. 2.
Figure 4:
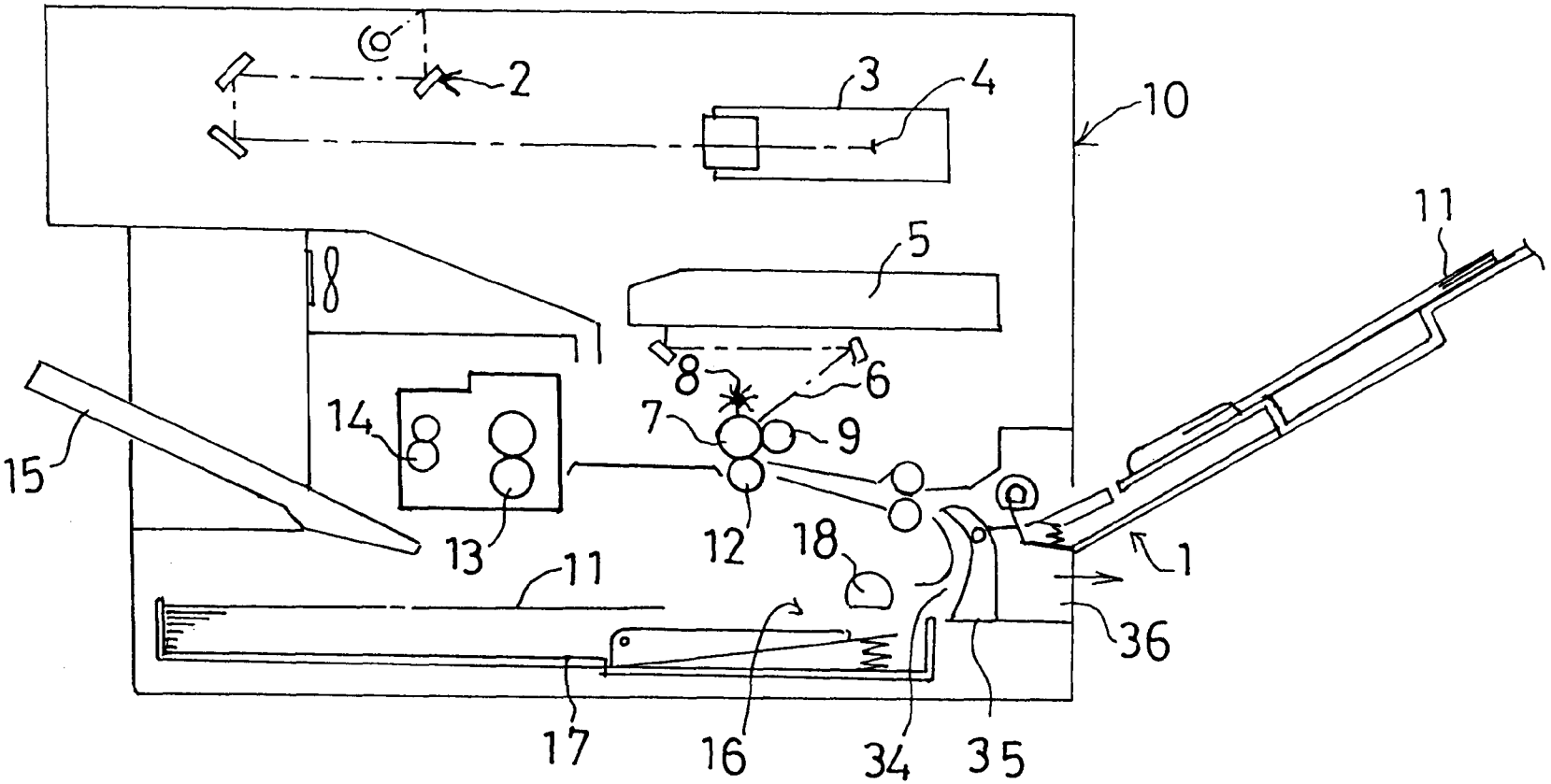
FIG. 4 is a schematic view showing the structure of a copying machine in which the sheet feeder unit of FIG. 2 is incorporated.

A first embodiment of the present invention is shown in FIGS. 2 to 4, and implemented as a sheet feeder unit 1 for supplying recording sheets in a digital copying machine 10 as shown in FIG. 4. An original document which is either manually placed on a platen glass or automatically fed by a document feeding apparatus (not shown) is scanned by a scanning optical system 2. A scanned image is formed in an image sensor 4 in an image reader unit 3, which is converted into electrical image signals to be transmitted to a print head 5. The print head 5 projects out a laser beam 6 modulated by the image signals onto a photosensitive drum 7 to expose the image.

The photosensitive drum 7 is positioned substantially at the center of the main body of the copying machine 10, and its surface is evenly charged by a charging brush 8 for the exposure of the image. An electrostatic latent image formed on the charged surface of the photosensitive drum 7 is developed with toners in a developing unit 9 to be a visible image, which is transferred onto a cut sheet 11 conveyed from the sheet feeder unit 1 by a transfer roller 12 or the like. The cut sheet 11 is then carried to a fixing unit 13 to fix the transferred image thereon, after which the cut sheet 11 is discharged onto a discharge tray 15 directly or being by guided by a discharge roller 14.

The copying machine 10 is provided with a sheet feeding apparatus 16 at its bottom for supplying cut sheets 11 of a standardized type or sheets commonly used, which comprises an extractable feeder cassette 17 and a feeding roller 18 mounted in the main body of the copying machine 10 for pushing the sheets forward. While the sheet feeding apparatus 16 is built in the copying machine 10, the sheet feeder unit 1 is a cassette type sheet feeder on which recording sheets are manually placed, and thus projected from a side of the copying machine 10. The sheet feeder unit 1 is intended for use when it is desired to feed one or a plurality of cut sheets 11 of different quality or size which are not prepared in the main body of the copying machine 10.

Referring to FIG. 3, the sheet feeder unit 1 has a pair of side guides 22 provided at both sides of its feeder tray 21, the positions of which are adjustable according to a width of the cut sheets 11 corresponding to various different sizes thereof. Both side guides 22 are connectively moved with each other by a linking gear 23 within the feeder tray 21, so that the cut sheet 11 of any size is always centered on the feeder tray 21. The sheet feeder unit 1 of such cassette type is suitable for various kinds of cut sheets 11 including postcards, plastic sheets for overhead projectors, very thin sheets, or various other types of sheets.

The sheet feeder unit 1 is desired to have high sheet feeding performance capable of feeding any type of cut sheet 11, while its sheet feeding mechanism must be simple and compact, as the cassette type sheet feeder is one type of attachment which may not be very frequently used. While being highly capable of stably feeding any types of cut sheets 11, the sheet feeder unit 1 of the first embodiment is as simply constructed as the above mentioned prior art, in which the outermost cut sheet 11 pushed forward by the feeding roller 31 comes into contact with and causes the friction member 33 to back away, which prevents the other cut sheets from proceeding with the outermost cut sheet 11 by the frictional contact therebetween. It will be understood that the present invention may be applied to a sheet feeding apparatus commonly used and built in the copying machine, an automatic sheet feeder, or any other appliances.

The feeding roller 31 of the sheet feeder unit 1 is disposed on a side face of the main body of the copying machine 10. The feeder tray 21 extends laterally and upwardly from a base 36 with an outer guide 35 which defines a sheet conveying path 34 for guiding a cut sheet 11 fed from the sheet feeding apparatus 16 toward the photosensitive drum 7. The base 36 is connected to the main body of the copying machine 10 by a hinge (not shown) at its one side, around which the base 36 is rotated together with the feeder tray 21 to open/close the sheet conveying path 34 for removing jammed paper.

The feeder tray 21 has a plate 26 which is rotatably supported by a shaft 24 at its one end and urged upward by a spring 25. The plate 26 presses the pile of cut sheets 11 on the feeder tray 21 toward the feeding roller 31, which pushes the outermost or uppermost cut sheet 11 forward by its rotation. The surface of the feeding roller 31 is made of rubber such as ethylene propylene diene monomer (EPDM) or the like to provide an appropriate amount of frictional force. The material of the feeding roller 31 is of course not limited to the one mentioned above.

The feeding roller 31 is configured to be semicircular in cross section, the cutaway flat portion of which is usually opposed to the cut sheets 11, and the feeding roller 31 is rotated to cause its curved periphery to contact the cut sheet 11 to send it out. When the sheets are not to be fed, a cam 31*b* which is rotated in synchronism with the feeding roller 31 is contacted with a cam follower 26*a*, which presses down the plate 26 against the force of the spring 25, to bring the cut sheets 11 apart from the feeding roller 31, so that the pile of cut sheets 11 can be readily placed at a predetermined location on the feeder tray 21 by hand where the cut sheets 11 come into contact with the friction member 33, or the cut sheets 11 can be removed therefrom.

At the time of feeding sheets, when the feeding roller 31 starts to rotate, the cam 31*b* comes apart from the cam follower 26*a* at the same time or slightly after the cutaway portion of the feeding roller 31 comes out of opposition to the cut sheets 11. The plate 26 being freed is thus pushed upward by the spring 25 to press the cut sheets 11 onto the periphery of the rotating feeding roller 31.

The friction member 33 of this embodiment is made of an elastic sheet, so that the friction member 33 can be elastically deformed to warp when the cut sheet 11 is sent out by the feeding roller 31. The friction member 33 stops the cut sheet except the uppermost one, thereby separating the uppermost cut sheets 11 from the other cut sheets 11 by the frictional contact therebetween and supplies the cut sheets one by one from the uppermost side thereof. For this reason, the friction member 33 is extended from the lowermost side of the pile of cut sheets 11 toward a conveying path 30 of the cut sheets, with its lower end fixedly connected to a support wall 37 standing upright under the conveying path 30 by any appropriate manner such as bonding or bolting.

The mechanism of how the friction member 33 separates the cut sheets can be theoretically and quantitatively explained by the combination of the backing away movement of the friction member 33 and partial deformation of the cut sheets as follows.

Figure 5A:
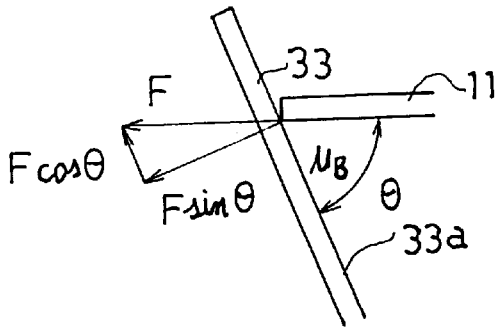

FIG. 5A shows a state where the force F of proceeding cut sheet 11 balances the frictional force on the surface 33*a* of the friction member 33, which is expressed by an equation $$F \cos \theta = \mu B \cdot F \sin \theta \quad (1), \text{ where}$$

$\mu$B is a friction coefficient of the frictional surface 33*a* with respect to the cut sheet 11, and θ (fixed value) is the angle made between the cut sheet 11 and the frictional surface 33*a*. From above, the following relations are derived.

$$\mu B \cdot \tan \theta < 1 \text{ (cut sheet proceeds)} \quad (2)$$

$$\mu B \cdot \tan \theta \geqq 1 \text{ (cut sheet stops)} \quad (3)$$

Figure 5B:
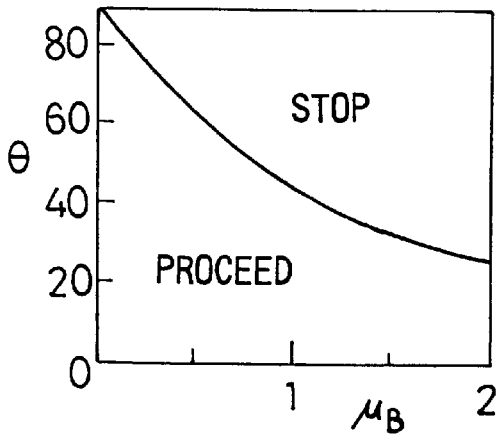
Figure 5C:
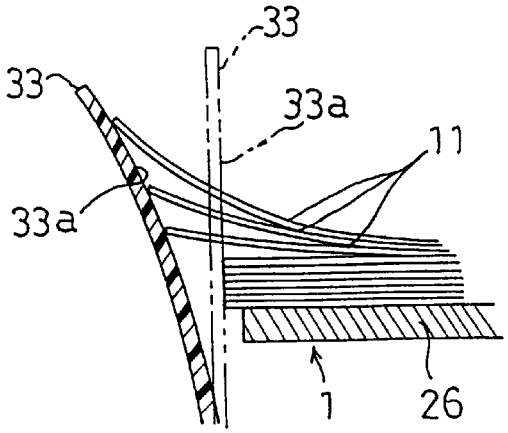

FIG. 5B shows critical angles of contacting angle θ within the range of appropriate friction coefficient $\mu$B where the cut sheet 11 slips to proceed.

It can be seen from the above inequalities (2),(3) that, theoretically, whether the cut sheet 11 proceeds or not does not depend on the force F but on the values of the friction coefficient $\mu$B and the angle θ. Thus, if the $\mu$B is invariable, it is necessary to give a difference in the contacting angle θ between the outermost cut sheet 11 and the other cut sheets 11 with respect to the frictional surface 33*a*. In other words, the outermost cut sheet 11 can be separated by changing the contacting angle θ from the "STOP" area to the "PROCEED" area of the graph shown in FIG. 5B.

However, the cut sheets 11 are normally placed in a pile in tight contact with each other and there is virtually no difference in the angle θ made by each cut sheet 11 and the frictional surface 33*a*.

The friction member 33, while being pushed back by the advancing cut sheet 11, causes the outermost cut sheet 11 to curve by the frictional force of contact more than the other following cut sheets 11, so that the angle θ made by the outermost cut sheet 11 and the frictional surface 33*a* becomes much more acute than that of the other cut sheets 11, thus separating the cut sheets 11 from each other and allowing only the outermost cut sheet to pass through while stopping the others.

Nevertheless, it is still difficult to ensure that the cut sheets 11 are fed one by one without any residual deformation which may be caused by too much force from the friction member 33, because the resiliency of cut sheets varies depending on their type, quality, and thickness.

In this embodiment, a pair of feeding rollers 31 is provided at symmetrical positions about the center of the sheet conveying path of the cut sheets 11, so as to advance the cut sheets without skew. The pair of feeding rollers 31 allows the cut sheets 11, which may not be centered on the feeder tray 21 depending on their size, to also be fed without skew.

The friction member 33 may be disposed in the middle between the pair of feeding rollers 31, in which case the force of advancing the cut sheets 11 by the pair of feeding rollers 31 is exerted to the central area of the cut sheets 11, allowing the uppermost cut sheet 11 to naturally deform to be convex in a width-wise direction, without causing the cut sheet 11 to be skewed. The same is applied to a case in which multiple pairs of feeding rollers are provided. If there is only one feeding roller provided, friction pieces may be preferably provided at both sides of the feeding roller. In case that the feeding roller is eccentrically disposed or mounted in plurality at various positions, the friction pieces may be provided in a corresponding number at corresponding positions to balance the feeding rollers.

The friction member 33 is positioned within the area defined by the outside dimension of the feeding rollers 31 as can be seen from FIG. 2, where the cut sheet 11 comes into frictional contact with a frictional surface 33*a*. The distance between the frictional surface 33*a* and a nipping position N, as indicated on FIG. 3 where the feeding rollers 31 contact the uppermost cut sheet 11 to advance the cut sheet 11, is much smaller than that of the prior art arrangement described above. The cut sheet 11 between the nipping position and the frictional surface 33*a* is restrained from being unfavorably deformed to ensure that the cut sheet 11 is received by the friction member 33 with an appropriate amount of frictional force, enhancing the performance of the friction member 33 and allowing it to be suitable for high-speed feeding. Favorable results were obtained by determining the angle of the friction member 33 in the manner described above.

Figure 6:
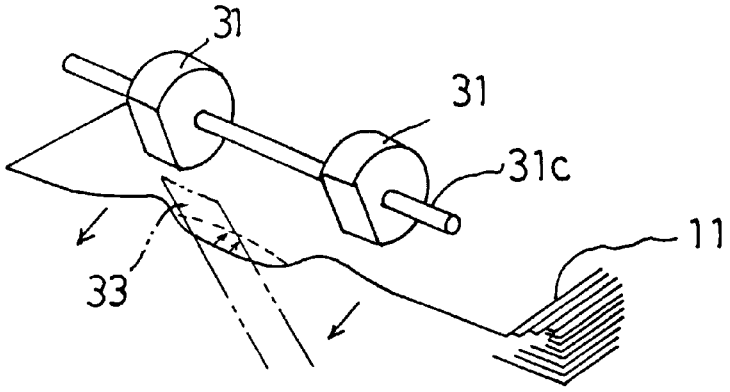
FIG. 6 is an explanatory view showing deformation of a cut sheet when fed by the sheet feeder unit of FIG. 2.

However, when the friction member 33 is disposed so near the feeding rollers 31 as in this arrangement, the leading end of the cut sheet 11 is prone to residual deformation: The leading edge is stopped by the friction surface 33*a*, while the other part of the cut sheet pressed by the feeding roller 31 is advanced, as a result of which the cut sheet 11 can become deformed as shown in FIG. 6.

In order to prevent such residual deformation, the friction member 33 must be able to resiliently warp or to be backed away against an urging force of a rebounding spring. The friction member of the first embodiment is made of a resilient sheet, which is preferable in terms of production cost. More specifically, a polycarbonate film may be employed as the material for the resilient sheet, and a film of about 200 micrometers thickness which is available on the market will provide enough rebounding force. The friction member 33 allows the deforming cut, sheet 11 to proceed along the curved frictional surface 33*a* of the resilient friction member 33, thereby preventing residual deformation of the cut sheet 11. The frictional surface 33*a* may be formed to be substantially planar or slightly curved so as to smoothly allow the cut sheet 11 to pass through thereon.

The friction member 33 may be extended to a position over an axis of a rotation shaft 31*c* for the feeding roller 31, so that the friction member 33 can be initially warped by contacting the rotation shaft 31*c*. The angle made between the frictional surface 33*a* and an outermost cut sheet 11 may be preferably set within the range of about 90° to 120°, whereby the cut sheet 11 is advanced to contact with the frictional surface 33*a* at an angle within this range, and can be smoothly conveyed along the curved frictional surface 33*a*. In contrast to the prior art arrangement in which the contacting angle of the cut sheet 11 is set smaller to enhance the sheet separating capacity, the cut sheet is advanced toward the frictional surface 33*a* at a wider angle of 90° to 120° in this embodiment, which was determined based on an experiment conducted by the inventors. The separation of cut sheets 11 is successfully made by disposing the friction member 33 close to the feeding roller 31 which allows the whole advancing force of the cut sheet to be used to prevent residual deformation, thereby increasing the sheet conveying speed.

The frictional surface 33*a* is provided with a necessary friction coefficient by coating the surface of polycarbonate film with a material having a high friction coefficient such as urethane resin by a silk screen printing method or the like. The frictional surface 33*a* may preferably have about a 1.0 to 1.5 static friction coefficient with respect to standard fine paper. This makes the frictional force between the frictional surface 33*a* and the outermost cut sheet 11 to be greater than that between the frictional surface 33*a* and the following cut sheets 11, assuring the sheet separating performance.

The feeding roller 31 is so positioned that when given one turn to send out one cut sheet 11 and the rear end of the cut sheet 11 is passed through the nipping position N, the friction member 33 becomes freed from the pressing force of the cut sheet 11 and returns to its initial position. Other cut sheets 11 following the previously fed cut sheet 11 are pushed back by the rebounding force of the friction member 33 to prevent them from becoming obstructions to the succeeding sheet feeding. The friction member 33 with the prescribed angle condition can successfully accomplish such object.

Figure 1:
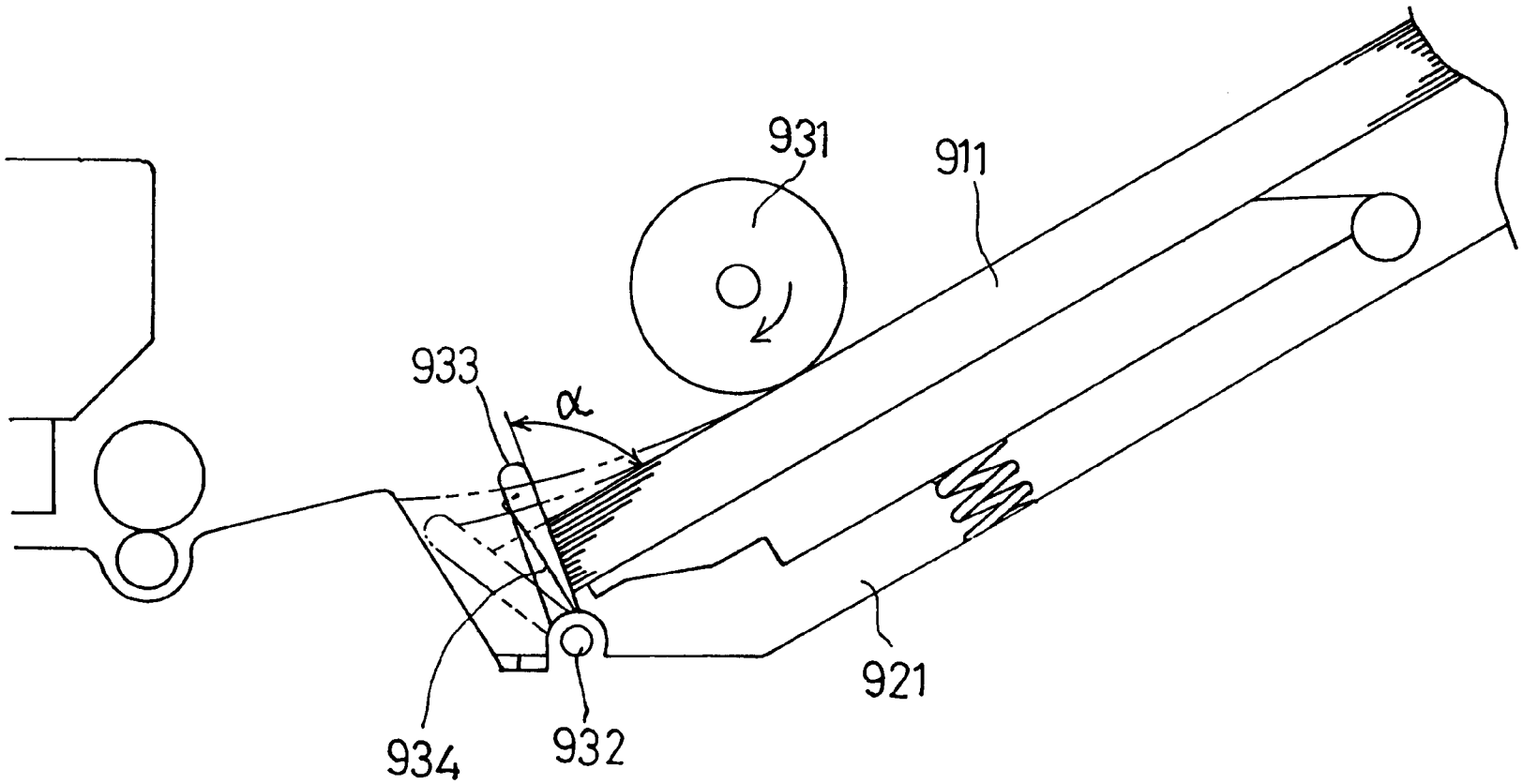
Fig. 1 Prior Art
FIG. 1 is a sectional view showing primary parts of a conventional sheet feeder unit.

When the base 36 of the sheet feeder unit 1 is opened to reveal the sheet conveying path 34, the friction member 33 is forwardly drawn out slipping under a rotating shaft 31*c* of the feeding rollers 31. The rotating shaft 31*c* thus prevents the friction member from returning to its initial position as shown by a phantom line in FIG. 1, when the base 36 is closed. For that reason, a boss 31*a* is provided on the rotating shaft 31*c* which catches the tip of the friction member 33 to push it back to the position denoted by the solid line when the feeding rollers 31 are rotated to start feeding sheets, thus ensuring automatic restoration of the friction member 33 to its proper position.

<Second Embodiment>

A second embodiment differs from the first embodiment in that the feeding roller 31 is provided with a projection 31*d* on its rotation shaft 31*c* which contacts the tip of the friction member 33 only for a given period of time before and after feeding sheets.

Figure 7A:
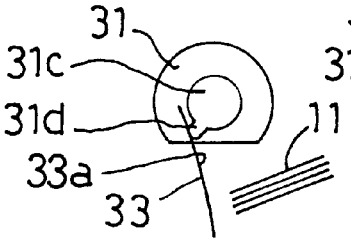
FIGS. 7A–7D are sectional views for explanation of primary parts of a sheet feeder unit according to a second embodiment of the present invention, showing the conditions prior to, after, and during the sheet feeding, respectively.
Figure 7B:
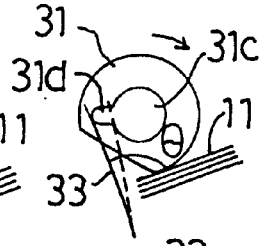
Figure 7D:
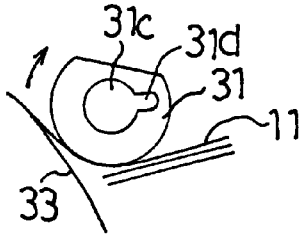
Figure 7C:
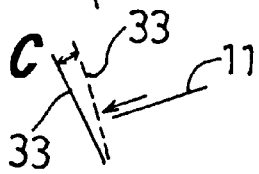

Referring to FIG. 7A, the projection 31*d* contacts the friction member 33 lower than its tip, thereby causing the friction member 33 to be warped when the feeding roller 31 is stationary. As the feeding roller 31 starts to rotate, the projection 31*d* causes the friction member 33 to warp further as shown in FIG. 7B, while the feeding roller 31 starts to feed the uppermost cut sheet 11 as shown in FIG. 7C. A broken line in FIGS. 7B and 7C denotes the friction member 33 in its initially curved state. As can be seen, the friction member 33 is further warped to cause the angle θ to become wider at the time when the sheet feeding is started. As shown in FIG. 7D, the uppermost cut sheet 11 is separated by the frictional contact between itself and the frictional surface 33*a* and fed out. The same effects as those of the first embodiment can be thereby achieved, while residual deformation of cut sheet 11 is further prevented by widening the angle between the cut sheet 11 and the frictional surface 33*a* only when the cut sheet is advanced toward the frictional surface 33*a*. The projection 31*d* can also serve as the boss 31*a* described in the first embodiment.

<Third Embodiment>

Figure 8B:
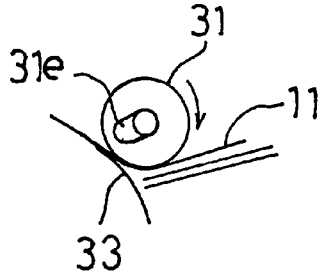
FIG. 8A is a perspective view and FIG. 8B is a sectional view of primary parts of a sheet feeder unit according to a third embodiment of the present invention, respectively showing the conditions after and during the sheet feeding.
Figure 8A:
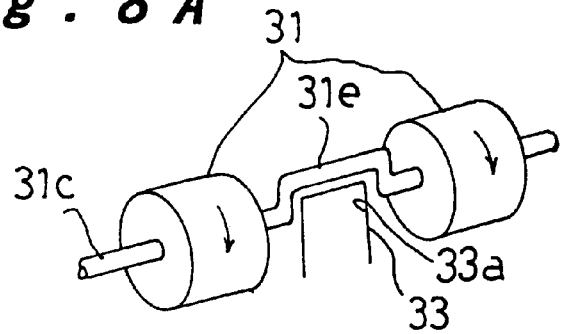

FIGS. 8A and 8B show a third embodiment of the present invention in which a crank 31*e* is provided with the rotation shaft 31*c* of the feeding roller 31, which, when the shaft is rotated, goes over the friction member 33. The third embodiment differs from the first embodiment in this point but achieves the same effects. When the sheet feeding is completed, the friction member 33 can automatically return to its initial position without being obstructed by the rotation shaft 31*c* by the provision of the crank 31*e* as shown in FIG. 8A. The cut sheets 11 other than the uppermost one are pushed back by this rebounding force of the friction member 33 and the edges of the cut sheets 11 are aligned to facilitate the succeeding sheet separation. The amount of maximum eccentricity of the crank 31*e* may be set smaller than the radius of the feeding roller 31. Since the friction member 33 with pushed by the cut sheet 11 is deformed outside the outer dimension of the feeding roller 31, the friction member 33 and the crank 31*e* do not obstruct each other.

<Fourth Embodiment>

Figure 9:
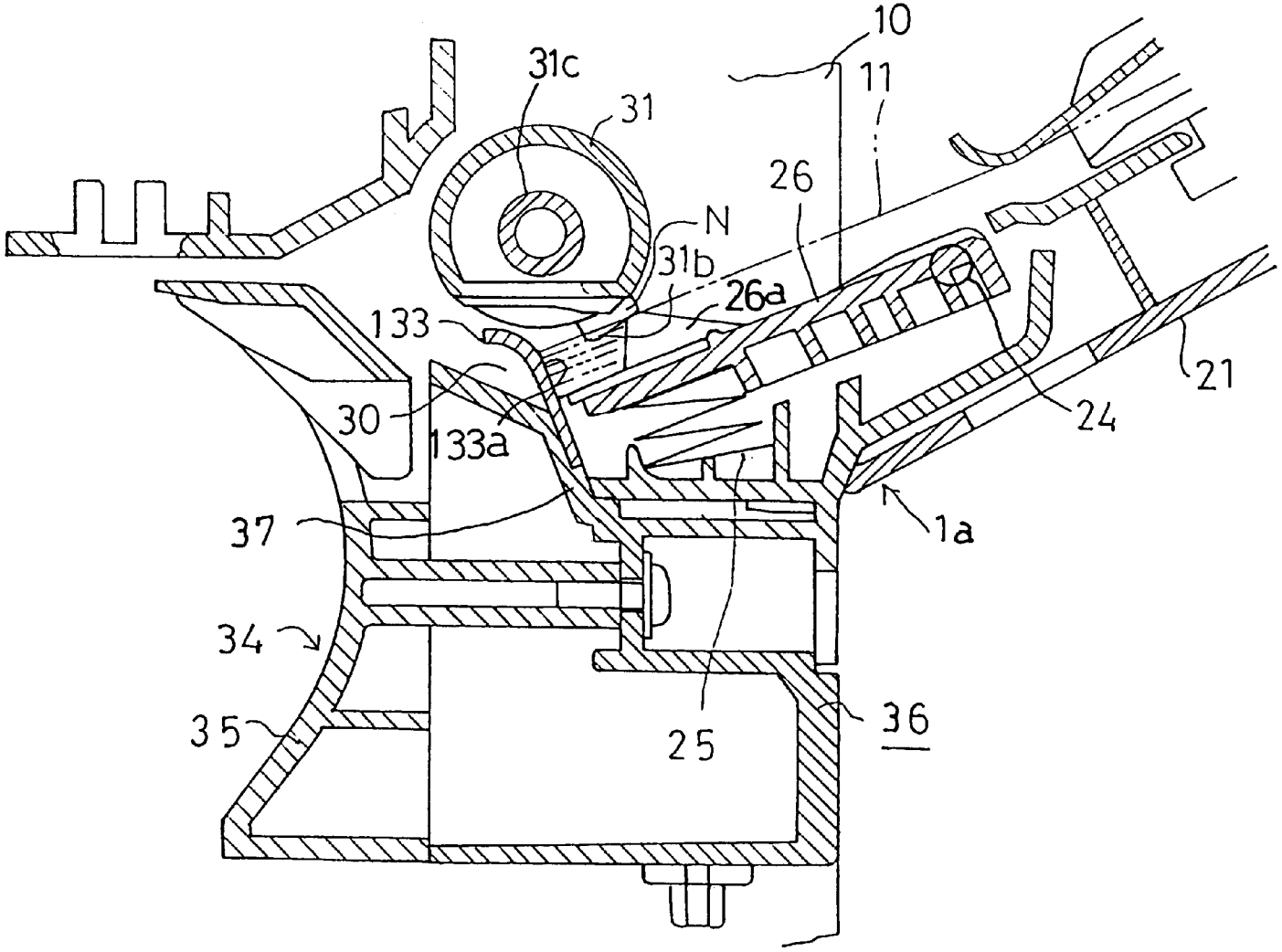
FIG. 9 is a sectional view showing primary parts of a sheet feeder unit according to a fourth embodiment of the present invention.
Figure 10A:
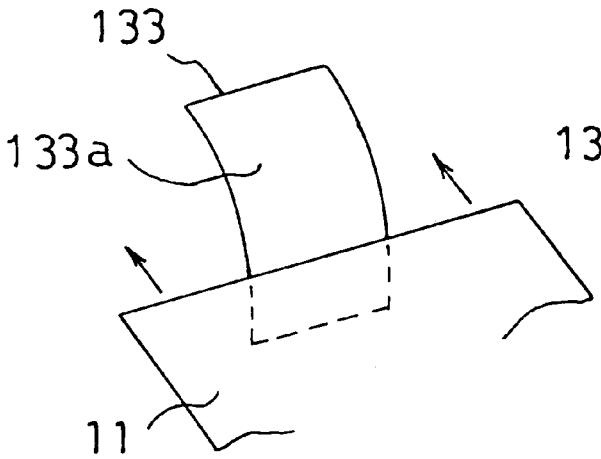
FIGS. 10A and 10B are perspective model views showing the way of installing the friction member in the sheet feeder unit of FIG. 9 and its modification.
Figure 10B:
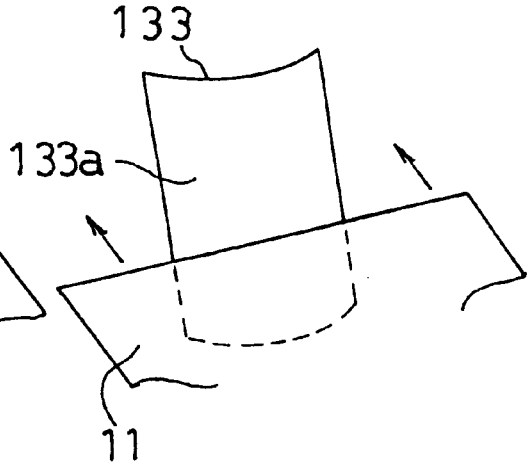
Figure 11:
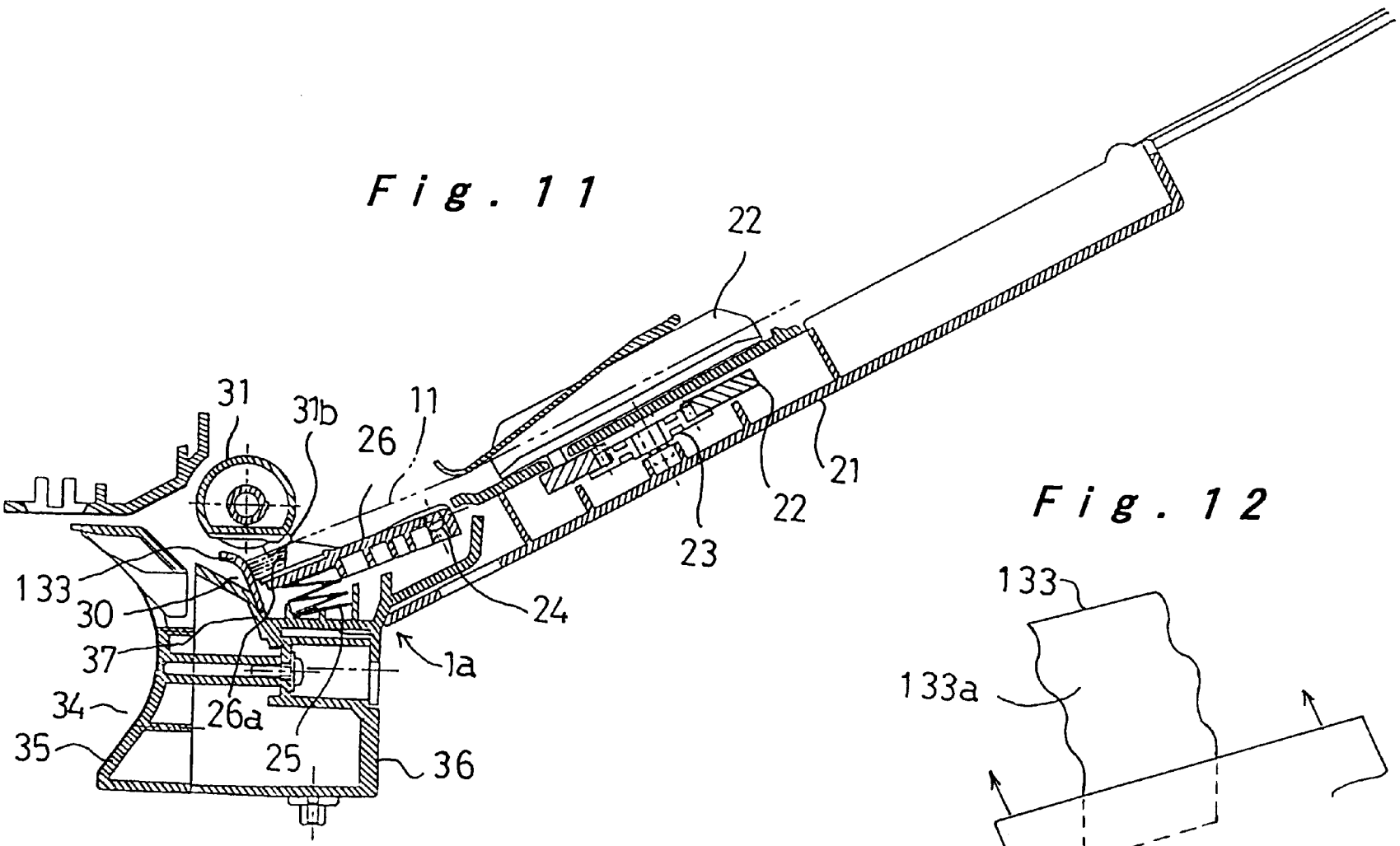
FIG. 11 is a sectional view of an entire body of the sheet feeder unit of FIG. 9.

A fourth embodiment of the present invention shown in FIGS. 9 to 11 is also implemented as a sheet feeder unit incorporated in a copying machine 10 as shown in FIG. 4 for feeding recording sheets, which is given the reference numeral of 1*a* to be distinguished from the sheet feeder unit 1 of the foregoing embodiments. The arrangement of the entire sheet feeder unit 1*a* is substantially the same as that of the first embodiment, in which like parts are given the same reference numerals, and only the differences will be hereinafter described.

The friction member 133 of the fourth embodiment is made of a rigid plate, and separates the outermost cut sheet 11 from the other cut sheets by the frictional force generated between itself and the cut sheet 11. Unlike the friction member 33 in the first embodiment, the rigid friction member 133 of the fourth embodiment is not resiliently bent back when the cut sheet is advanced thereto.

In this embodiment, the friction member 133 consists of a plate made of plastic or metal. The surface of the friction member 133 is coated with a material which generates a great frictional force such as urethane resin or the like by a silk screen printing method to provide a frictional surface 133*a*. Preferably, the frictional surface 133*a* has a static frictional coefficient of about 1.0 to 1.5 with respect to a standard sheet of fine paper, and the angle made between thefrictional surface 133*a* and the uppermost cut sheet 11 is set between 90° to 120°.

The friction member 133 in this embodiment is formed to be continuously bending in such a way that its inclination becomes gradually moderate along the direction of frictional contact as can be seen from FIGS. 9 and 10A. Specifically, friction member 133 may be provided with a given curvature by any appropriate means such as a thermal bending process which allows for prevention of springback of the plastic material. The friction member 133 made of plastic or metal may be thick enough to be rigid but not so thick as to cause the cut sheet to be unfavorably deformed.

As described above, the friction member 133 is formed to be curved instead of being resiliently pushed back by an advancing cut sheet 11, and such arrangement allows the friction member 133 to separate cut sheets of any physical properties in a manner described below. The cut sheet 11 advanced toward the friction member 133 is first contacted against a steep slope at a lower part of the friction member 133, making an angle acutely enough to direct the cut sheet upwardly. As the cut sheet 11 proceeds toward the tip of the friction member 133, the portion of the curved frictional surface 133*a* with a more moderate curvature allows the cut sheet 11 to readily pass through thereon. Cut sheets having any physical properties can be thus stably separated and fed one by one without any residual deformation.

After the uppermost cut sheet 11 is fed out, the other cut sheets are stopped by the steep lower part of the friction member 133 and returned to their set position by gravity, thus preventing an obstruction for the next sheet feeding. Though rigid in this embodiment, the friction member 133 may also be given a certain amount of resiliency to assist the above described function.

Alternatively, when a pair of feeding rollers 31 is provided and the friction member 133 is disposed in the middle between the pair of feeding rollers 31, the friction member 133 may be so constructed to have its frictional surface 133*a* latitudinally warped with its central part extended toward the upstream side of the sheet feeding direction as shown in FIG. 10B. This helps the smooth separation of cut sheets 11, as the friction member 133 is capable of conveying a naturally deformed cut sheet 11 along its own curved surface.

The friction member 133 has such a length that its tip is positioned lower than the rotation shaft 31*c* of the feeding roller 31, so that it does not obstruct the open/close operation of the base 36 to open and close the sheet conveying path 34, as the tip of the friction member 133 can pass through under the rotation shaft 31*c*.

<Fifth Embodiment>

Figure 12:
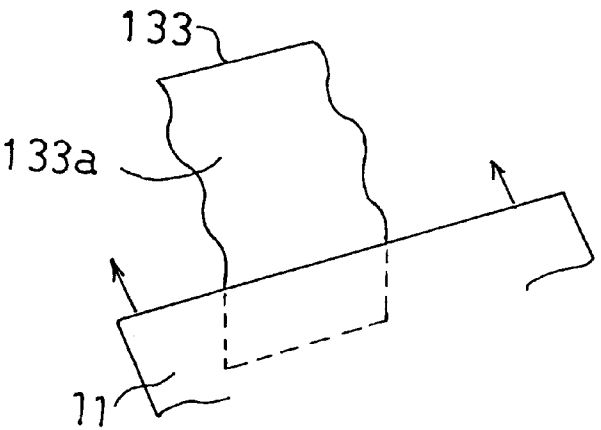
FIG. 12 is a perspective model view showing a friction member in a sheet feeding apparatus according to a fifth embodiment of the present invention.

A fifth embodiment of the present invention is substantially the same as the fourth embodiment, and only differs in that the friction member 133 is configured in a wavy form as shown in FIG. 12. Like parts are denoted by the same reference numerals and the description thereof will be omitted. As can be seen from FIG. 12, the inclination of the slope becomes alternatively sharp and moderate along the direction of frictional contact at a given curvature to make at least two undulations. The friction member 133 made of plastic or the like may be undulated, for example, by a thermal bending process or any other means which allows for the prevention of springback of the plastic plate. The friction member 133 made of plastic or metal may be thick enough to be rigid but not as thick as to cause the cut sheet to be unfavorably deformed.

The same effects can be thereby achieved as those of the fourth embodiment, and the surface of the friction member 133 in this embodiment assures even more stable sheet feeding by effectively separating a cut sheet 11 with its plurality of undulations.

<Sixth Embodiment>

Figure 13:
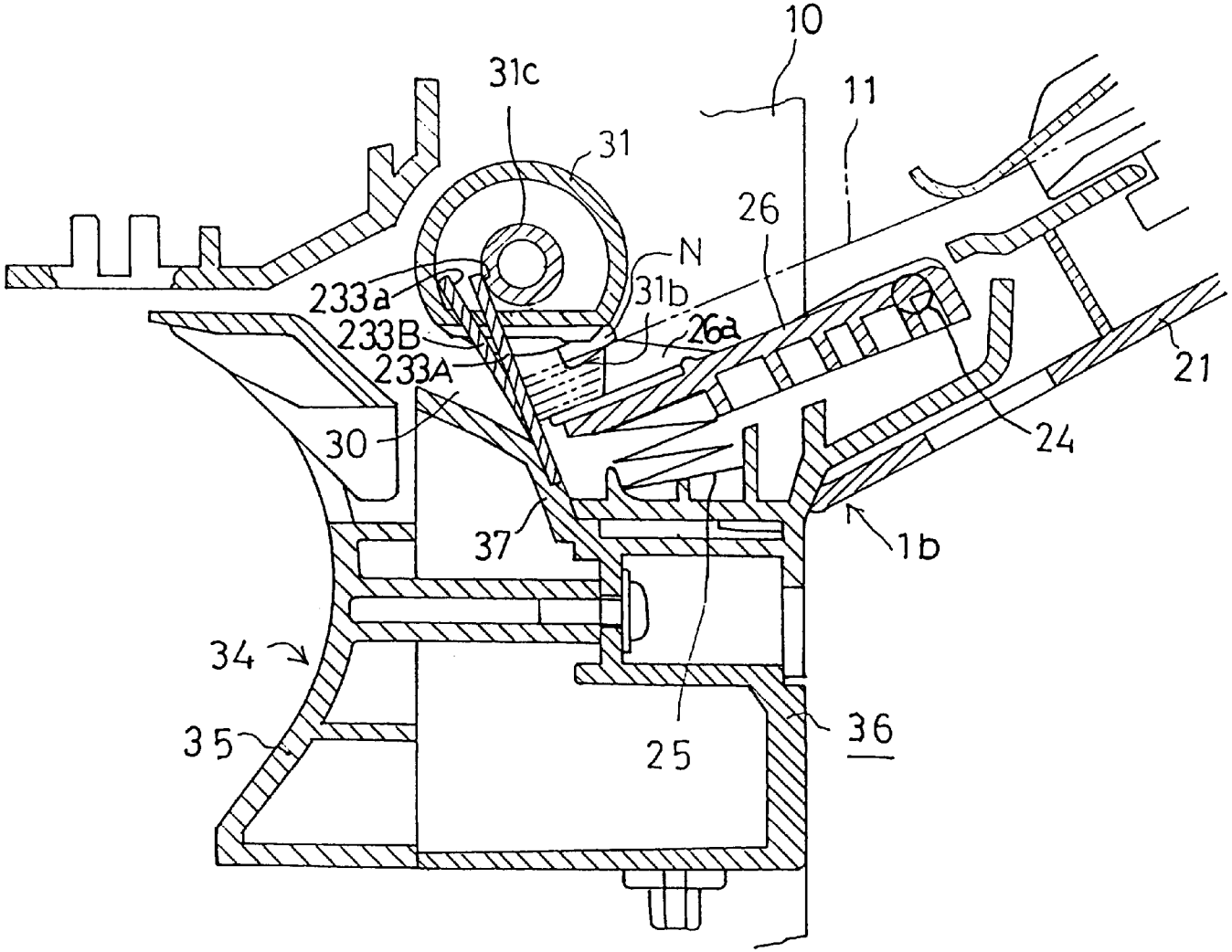
FIG. 13 is a sectional view showing primary parts of a sheet feeder unit according to a sixth embodiment of the present invention.
Figure 14:
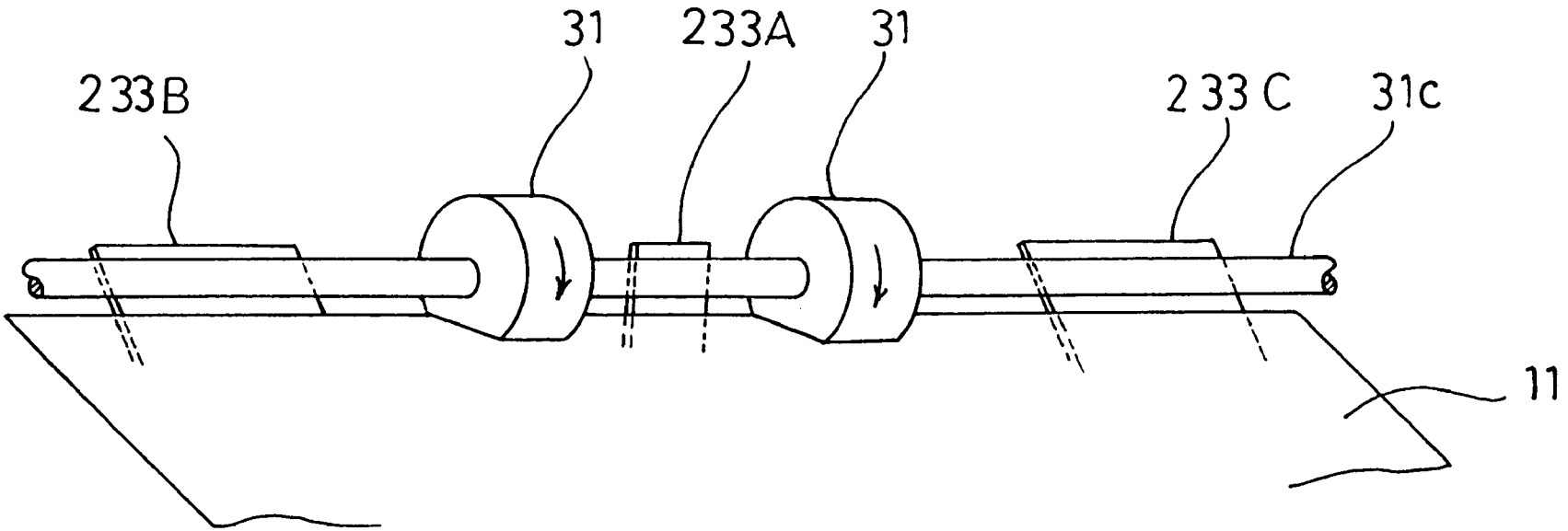
FIG. 14 is a perspective model view showing the friction member installed in the sheet feeder unit of FIG. 13.
Figure 15:
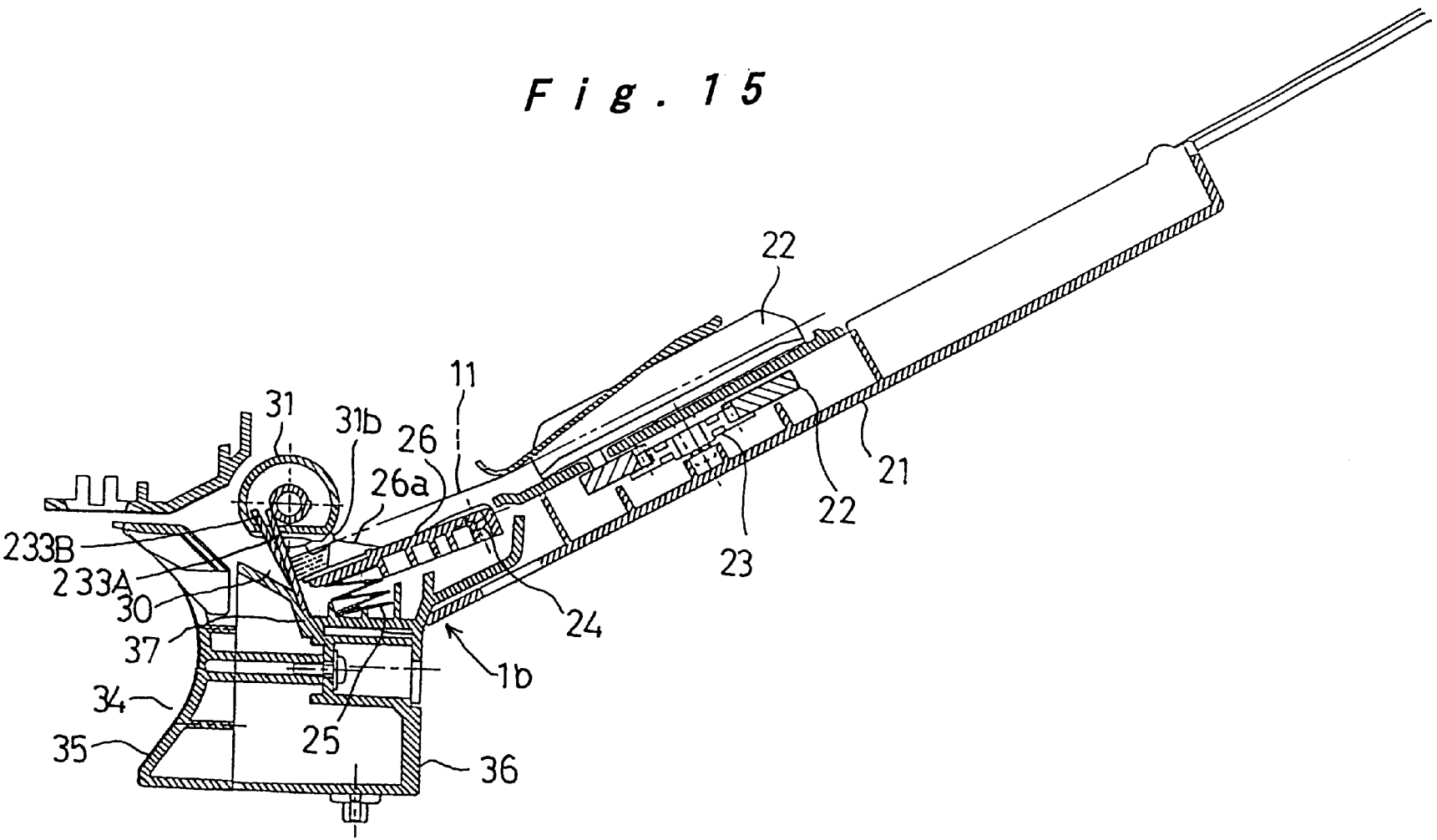
FIG. 15 is a sectional view of an entire body of the sheet feeder unit of FIG. 13.

A sixth embodiment of the present invention shown in FIGS. 13 to 15 is also implemented as a sheet feeder unit incorporated in a copying machine 10 as shown in FIG. 4 for feeding recording sheets, which is given the reference numeral of 1*b* to be distinguished from the sheet feeder unit of the foregoing embodiments. The arrangement of the entire sheet feeder unit 1*b* is substantially the same as that of the fourth embodiment, in which like parts are given the same reference numerals, and only the differences will be hereinafter described.

In this embodiment, a plurality of friction members 233 are disposed along a width direction of the cut sheet 11. For example, three friction members 233A–233C are respectively supported at their base ends by the support metal 37 at different angles and distanced from each other as shown in FIGS. 13 and 14. Specifically, the friction member 233A is contacted with the tip of the cut sheet 11 at a different angle from that between the other friction members 233B and 233C and the cut sheet 11 as shown in FIG. 14.

By this arrangement, the uppermost cut sheet 11 is first stably conveyed by the first friction member 233A, while the second and third friction members 233B and 233C assist the smooth sheet feeding, dissipating deformation stress of the cut sheet 11. Cut sheets 11 of any thickness can be thereby separated without any residual deformation and stably supplied one by one. The friction members 233A–233C are disposed in symmetry around the center of the cut sheet 11, but the disposition of the friction members may be variously arranged other than the example shown in FIG. 14.

In case that the feeding rollers 31 is provided, the first friction member 233A may be disposed in the middle between the pair of friction rollers 31, contacting the cut sheet 11 at a more acute angle than that between the other friction members 233B, 233C and the cut sheet 11. By this arrangement, the cut sheet 11 is basically treated by the central friction member 233A, by which the cut sheet 11 is smoothly separated along a natural curve of deformation without a twist or distortion. The first friction member 233A may be set to be shorter than the other friction members 233B, 233C so that, when supported at different angles, the heights of all the friction members 233A–233C are substantially aligned at the same level, which is desirable to prevent residual deformation of the cut sheet 11 when passing over the friction members 233A–233C.

<Seventh Embodiment>

Figure 16:
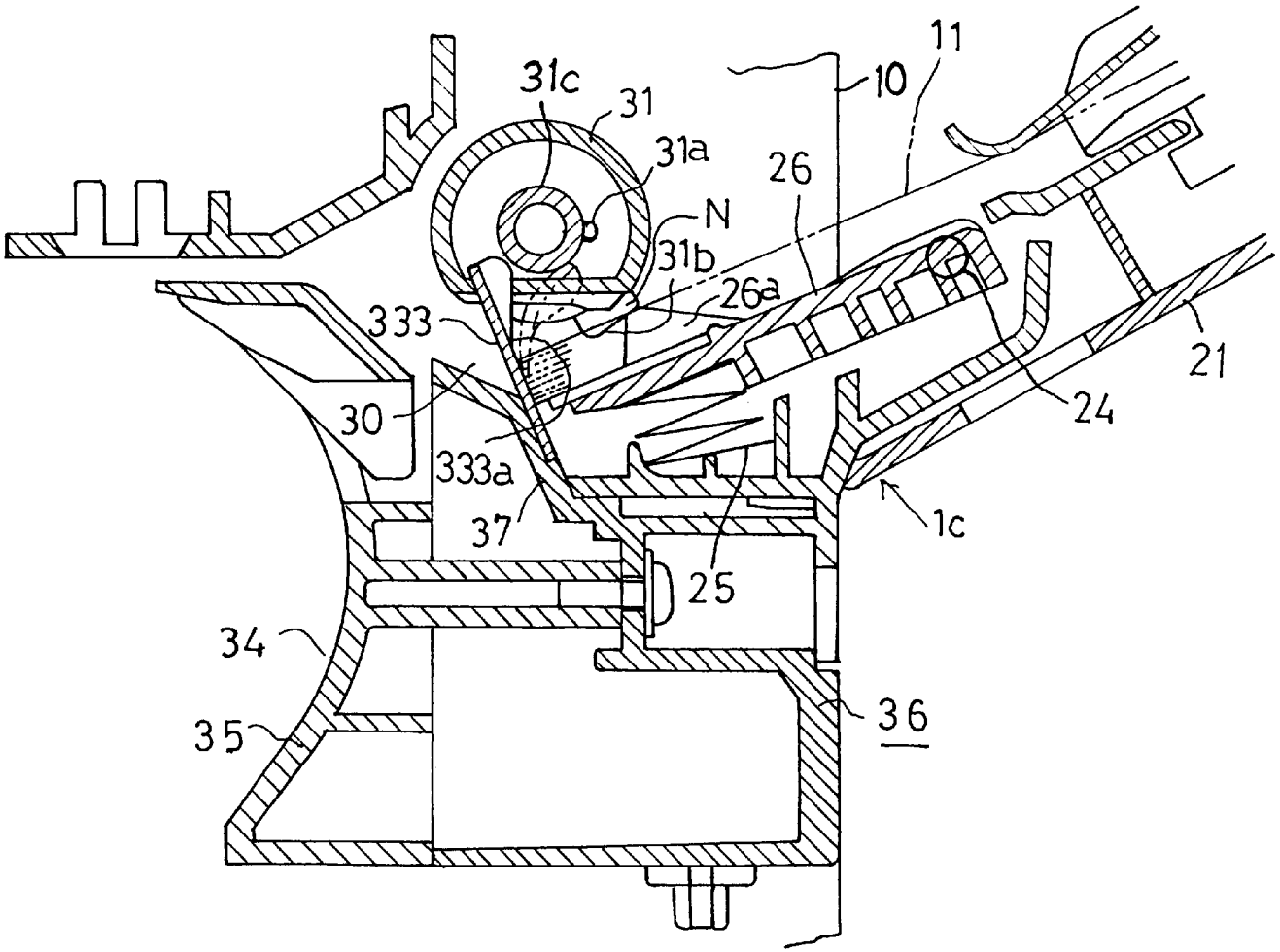
FIG. 16 is a sectional view showing primary parts of a sheet feeder unit according to a seventh embodiment of the present invention.
Figure 17A:
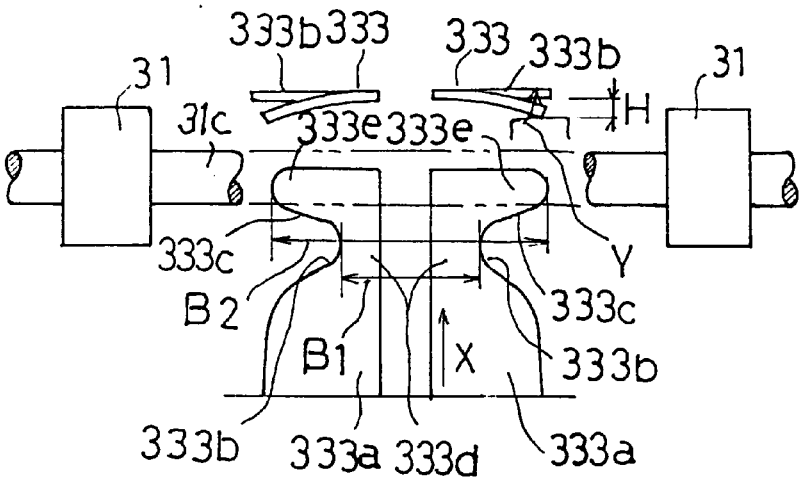
FIG. 17A is a front elevation view partly including a plan view, 17B is a longitudinal section view, and 17C is a perspective view, all showing the friction member installed in the sheet feeder unit of FIG. 16.
Figure 17B:
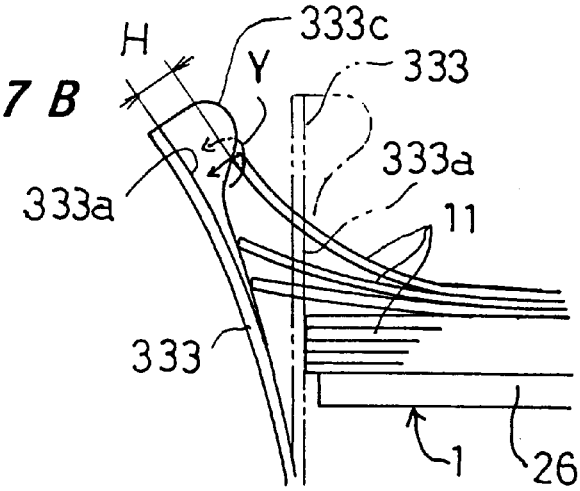
Figure 17C:
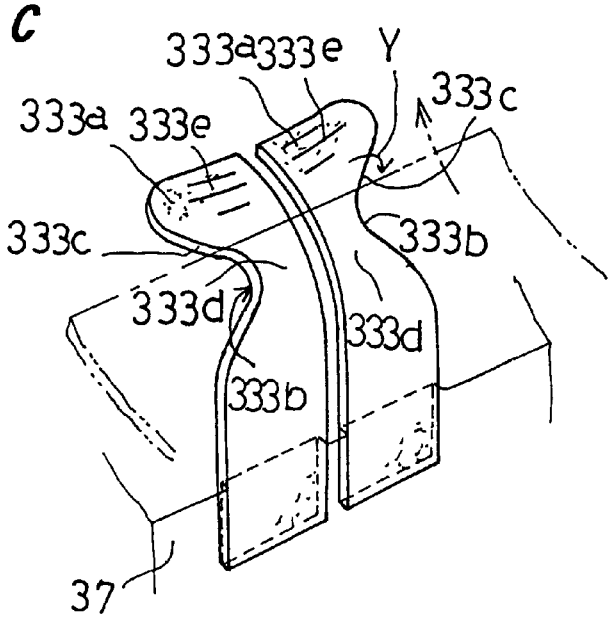
Figure 18:
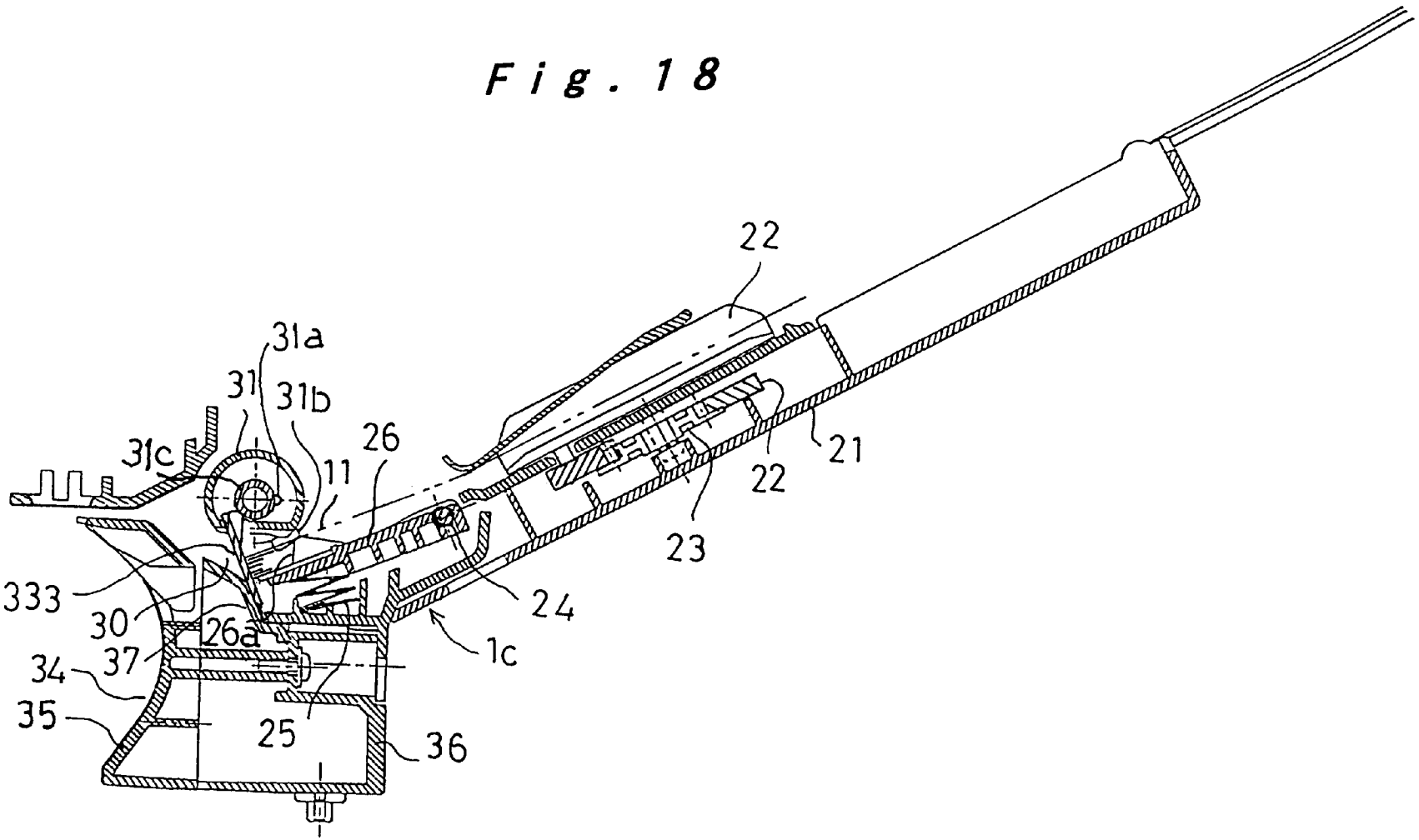
FIG. 18 is a sectional view of an entire body of the sheet feeder unit of FIG. 16.

A seventh embodiment of the present invention shown in FIGS. 16 to 18 is also implemented as a sheet feeder unit incorporated in a copying machine 10 as shown in FIG. 4 for feeding recording sheets, which is given the reference numeral of 1*c* to be distinguished from the sheet feeder unit of the foregoing embodiments. The arrangement of the entire sheet feeder unit 1*c* is substantially the same as that of the first embodiment, in which like parts are given the same reference numerals, and only the differences will be hereinafter described.

The friction member 333 in the seventh embodiment is, similarly with the first embodiment, made of a resilient sheet such as a polycarbonate film, which can be available on the market, having about 200 micrometers thickness to provide a proper amount of rebounding force. The surface of the polycarbonate film is coated with a material having a great frictional coefficient such as urethane resin applied by a screen printing method, preferably with a screen of about 200 meshes and finishing with thermosetting treatment for 30 minutes at 80° C. Preferably, the frictional surface 333*a* has a static frictional coefficient of about 1.0 to 1.5 with respect to a standard sheet of fine paper, and the angle made between the frictional surface 333*a* and the uppermost cut sheet 11 is set between 90° to 120°.

Further, the friction member 333 is so configured that the width of the frictional surface 333*a* greatly increases from a base side (B1) toward a distal end (B2) along the direction of frictional contact denoted by an arrow X in FIG. 17A.

When the cut sheet 11 is advanced by the feeding roller 31 to cause the friction member 333 to bend back and proceeds toward the tip of the friction member 333, the angle θ made between the friction member 333 and the cut sheet 11 as shown in FIG. 5A becomes acute. However, the friction member 333, formed to have a frictional surface 333*a* of which width becomes sharply greater toward the distal end thereof, can provide a sufficient amount of frictional force and keep the cut sheet 11 favorably warped, thereby assuring the stable sheet separation.

The above described configuration of the frictional surface 333*a* can be readily formed by providing notches 333*b* at side edges of the friction member 333 as shown in FIG. 17A. Alternatively, the frictional surface 333*a* of such configuration may be provided on a rectangular friction member 333 by coating urethane resin in a proper form as described above or by any other coarsening treatments to increase the frictional coefficient.

Also, instead of using a resilient sheet for the friction member 333, the friction member 333 may be made of a rigid material and given a rebounding force with a spring, without changing any of the above described effects and advantages.

Specifically in this embodiment, side edges 333*c*, configured in accordance with the figure of the frictional surface 333*a* of which width is sharply increased from B1 to B2, are formed to rise slightly toward the upstream side of the sheet feeding direction from narrower parts 333*d* to wider parts 333*e*. According to this arrangement, when the leading edge of the cut sheet 11 reaches the side edges 333*c* while causing the friction member 333 to resiliently bend back, the upturned side edges 333*c* catch the cut sheet 11 and push it back by the amount H, causing a twist in a direction denoted by an arrow Y while making the whole width of the frictional surface 333*a* at every position thereof contact with the cut sheet 11. Such frictional resistance is exerted on the advancing cut sheet 11, causing the cut sheet 11 to warp, thereby facilitating the separation from the following cut sheets 11. This, with the help of a sharp increase in width of the frictional surface 333*a*, enhances the sheet separating capacity, as well as decreases a necessary maximum width of the friction member 333.

Further, the friction member 333 of this embodiment is provided in a symmetrical pair as can be seen from FIGS. 17A and 17C, which further helps the friction member 333 to convey the cut sheet 11 smoothly along a lateral curve thereof without unfavorable residual deformation. The friction member 333 may also be provided in plurality and dispersedly disposed.

<Eighth Embodiment>

Figure 19:
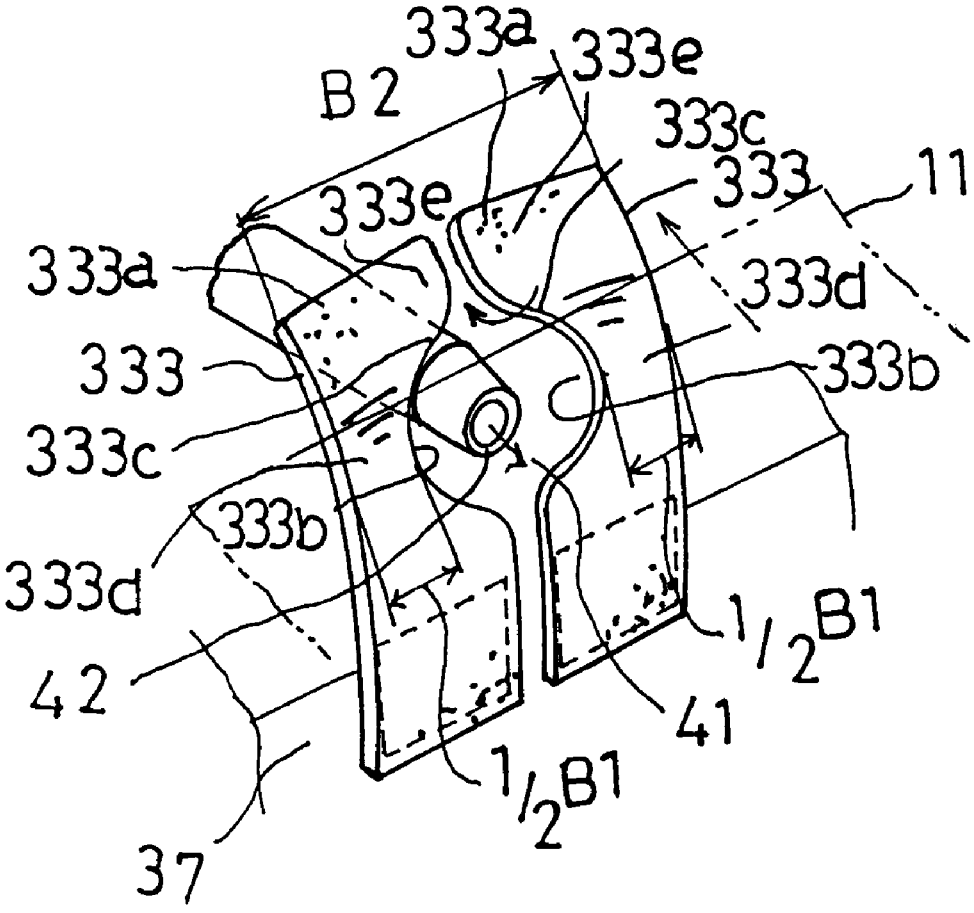
FIG. 19 is a perspective view showing a friction member in a sheet feeder unit according to an eighth embodiment of the present invention.

An eighth embodiment of the present invention is substantially the same as the seventh embodiment, and only differs in that the friction member 333 is provided with the notches 333*b* at inner edges thereof so that the whole width of the frictional surface 333 becomes sharply increased from B1 to B2 as shown in FIG. 19. The same effects as those of the seventh embodiment can be thereby achieved. Further, it is advantageous to have an aperture 41 made by the notches 333*b* of the pair of the friction members 33, as this can be utilized in case a nozzle 42 is provided to blow air toward the leading edges of the cut sheets 11 to assist the sheet separation. Such an arrangement may be applied to a high speed machine. In any case, the aperture 41 may not be necessarily provided.

<Ninth Embodiment>

A ninth embodiment of the present invention shown in FIGS. 20 to 23 is also implemented as a sheet feeder unit incorporated in a copying machine 10 as shown in FIG. 4 for feeding recording sheets, which is given the reference numeral of 1*d* to be distinguished from the sheet feeder unit of the foregoing embodiments. The arrangement of the entire sheet feeder unit 1*d* is substantially the same as that of the first embodiment, in which like parts are given the same reference numerals, and only the differences will be hereinafter described.

In this embodiment, similarly with the seventh embodiment, the friction member 433 is made of a resilient sheet such as a polycarbonate film, having about 200 micrometers thickness to provide a proper amount of rebounding force. The surface of the polycarbonate film is coated with a material having a great frictional coefficient such as urethane resin applied by a screen printing method, preferably with a screen of about 200 meshes and finishing with thermosetting treatment for 30 minutes at 80° C. Preferably, the frictional surface 433*a* has a static frictional coefficient of about 1.0 to 1.5 with respect to a standard sheet of fine paper, and the angle made between the frictional surface 433*a* and the uppermost cut sheet 11 is set between 90° to 120°. Under favorable ambient conditions with low humidity, the friction member 433 being fabricated as described above can have a stable sheet feeding performance for soft or thin cut sheets as well as thick sheets such as postcards.

Figure 20:
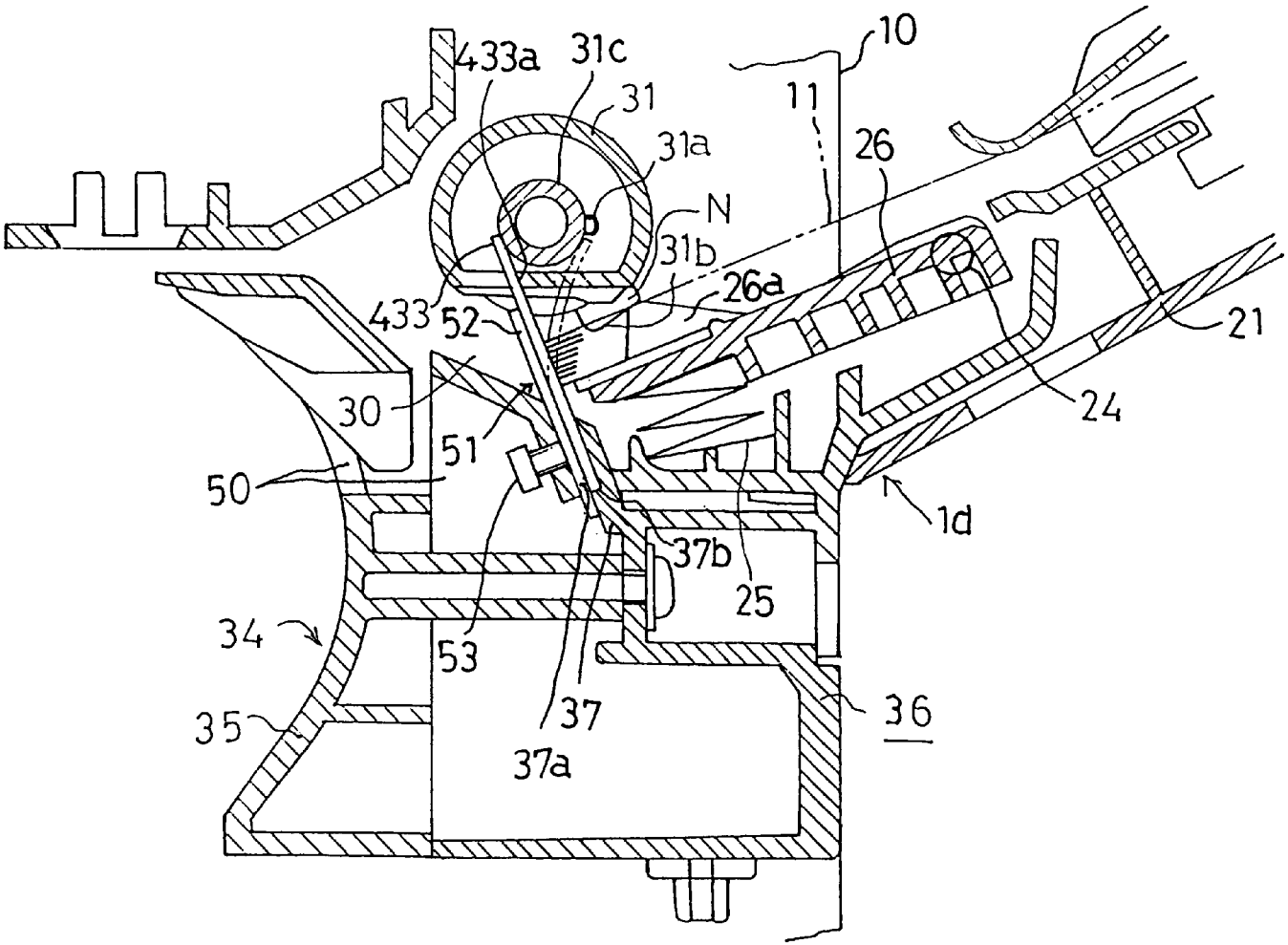
FIG. 20 is a sectional view showing primary parts of a sheet feeder unit according to a ninth embodiment of the present invention.
Figure 21:
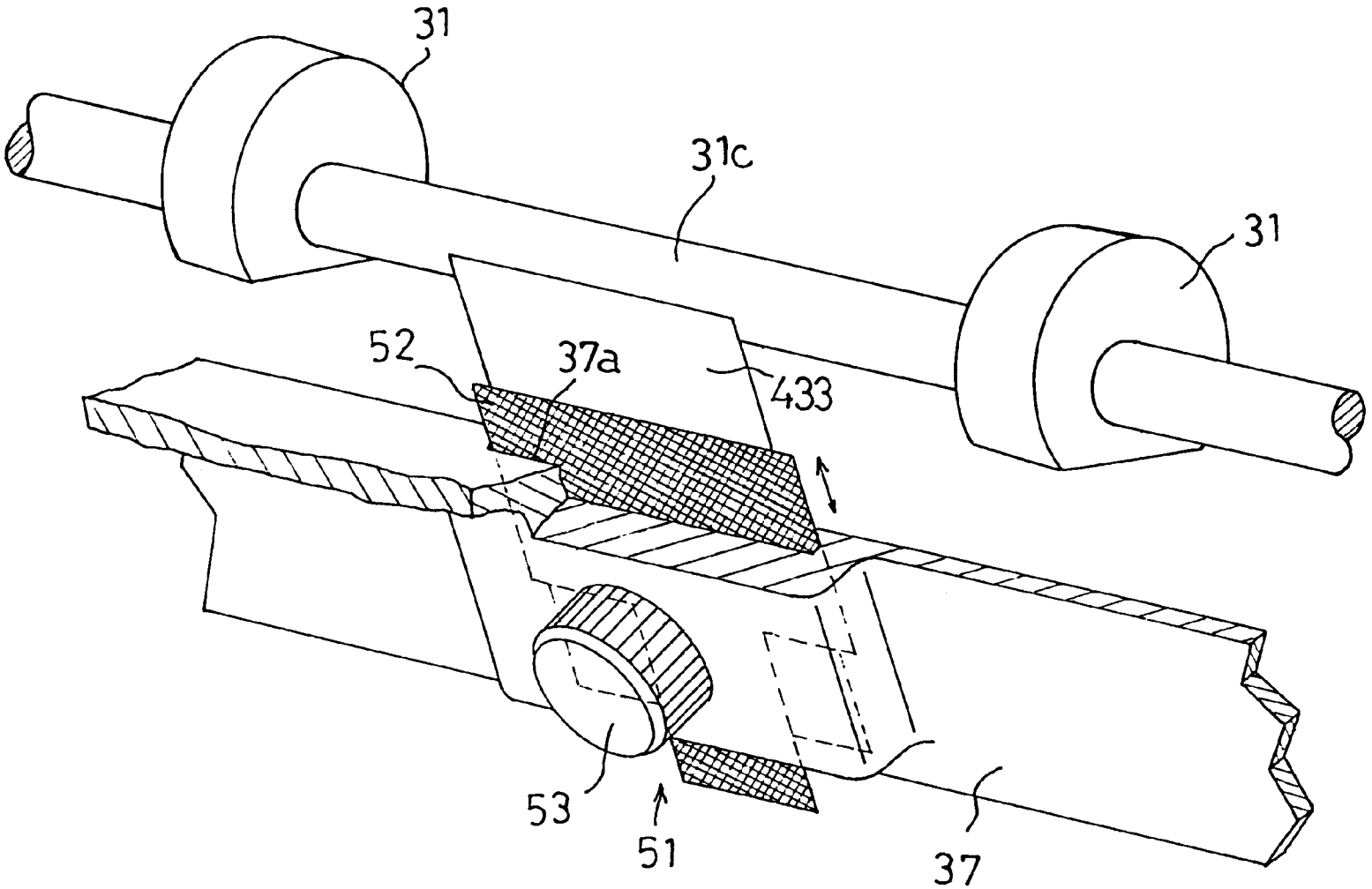
FIG. 21 is a perspective view showing a friction member installed in the sheet feeder unit of FIG. 20.
Figure 22:
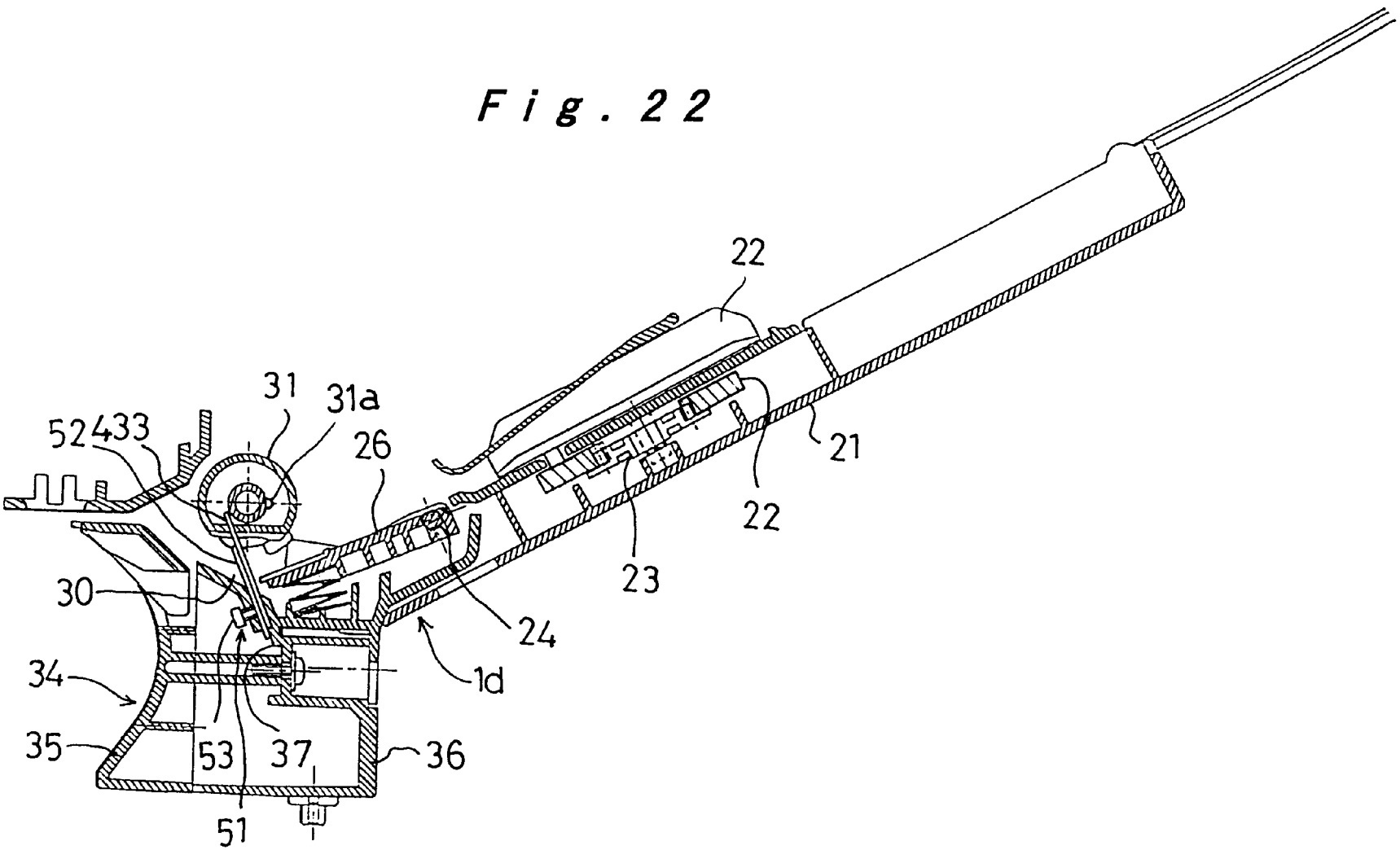
FIG. 22 is a sectional view of an entire body of the sheet feeder unit of FIG. 20.

Further, in this embodiment, an adjusting means 51 is provided for adjusting a rebounding force of the friction member 433 when pushed backward by the advancing cut sheets 11 as shown in FIGS. 20 to 22. When the sheet feeding performance is unstable due to various reasons including types of cut sheets 11 and the humidity which varies depending on weather, season, or region, the most appropriate sheet separating characteristics corresponding to differences in types of cut sheets or ambient conditions can be obtained by adjusting the rebounding force of the friction member 433 with the adjusting means 51.

The adjusting means 51 in this embodiment comprises a resilient sheet 52 which is attached to the back of the friction member 433 to assist the friction member 433 by giving a part of the rebounding force. The rebounding force can be increased or decreased by attaching and detaching the resilient sheet 52, or can be finely adjusted by using a resilient sheet 52 with different resiliency depending on its material or thickness. Even with the use of the same resilient sheet 52, the resiling force of the friction member 433 can be adjusted by changing the position or range of attachment of the resilient sheet 52.

The resilient sheet 52 is arranged to be adjustable in its position on the backside of the friction member 433 in a manner described below. The friction member 433 may be, for example, bonded at its lower end to the front inner side of a slit 37*a* which vertically penetrates the support wall 37, while the resilient sheet 52 is arranged to be vertically movable within the slit 37*a* behind the friction member 433 and is fixed with a screw 53 extending from the backside of the support wall 37 into the slit 37*a* at a given height. Since the screw 53 can also secure the friction member 433 together with the resilient sheet 52, the friction member 433 may not be separately bonded to the support wall 37. Though not essential, a step 37*b* may be provided within the slit 37 to receive the lower end of the friction member 433 as shown in FIG. 20. By providing such step 37*b*, the friction member 433 can be readily set at a given regular height before being secured by the screw 53 when it is unnecessary to adjust the height of the friction member 433.

Figure 23:
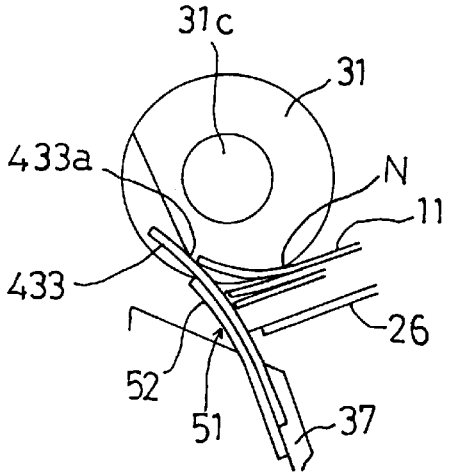
FIG. 23 is a sectional view showing an early stage of sheet feeding in the sheet feeder unit of FIG. 20.

When the area of the resilient sheet 52 contacting the backside of the friction member 433 is changed by adjusting its height, the rebounding force of the friction member 433 when pushed backward by the advancing cut sheet 11 as shown in FIG. 23 is changed even with the same resilient sheet 52. By increasing the area of the resilient sheet 52 in contact with the friction member 433, the more the rebounding force of the friction member 433 increases, thus enhancing the sheet separating performance, and by decreasing the area of the resilient sheet 52 contacting the friction member 433, the more the rebounding force of the friction member 433 decreases. The friction member 433 can thus be set to have desired sheet separating characteristics corresponding to types of the cut sheets or the ambient conditions depending on weather, season, or region.

It is also possible to mount the resilient sheet 52 fixedly instead of the friction member 433, in which case the rebounding force may be changed by adjusting the height of the friction member 433. Although the rebounding force generated by the resilient sheet 52 may be fixed, the whole rebounding force can be adjusted by varying the length of the friction member 433, allowing for delicate control of the sheet separating characteristics. Theoretically, the rebounding force is adjustable by the relative movements between the friction member 433 and the resilient sheet 52 in the direction of frictional contact between the friction member 433 and the cut sheet 11.

When the base 36 is opened, the guide 35 is exposed and provides an opening 50, through which the screw 53 is manually operated to adjust the height of the resilient sheet 52. Such operation may be, however, variously modified.

<Tenth Embodiment>

Figure 24:
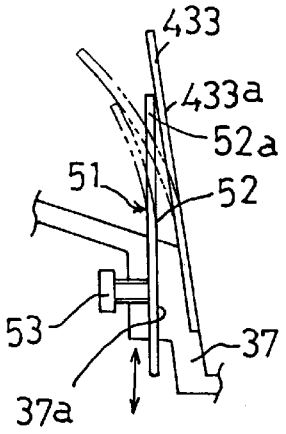
FIG. 24 is a sectional view showing primary parts of a tenth embodiment of the present invention.

A tenth embodiment of the present invention shown in FIG. 24 is substantially the same as the ninth embodiment except that the adjusting means 51 is arranged to have the resilient sheet 52 with its tip 52*a* obliquely contacting the backside of the friction member 433 from behind. The same parts are given the same reference numerals of which illustration and description will be omitted.

Since the resilient sheet 52 provides a part of the rebounding force of the resilient sheet 52 at the tip thereof where it increases the frictional force between the friction member 433 and the cut sheet 11, the desired amount of rebounding force, which is defined corresponding to the material or thickness of the resilient sheet 52, can be finely adjusted to have appropriate sheet separating characteristics for cut sheets of various kinds or conditions.

As the friction member 433 warps by being pushed back by the cut sheet 11, the resilient sheet 52 is also bent backward, contacting a greater area of the friction member 433 thus increasing the rebounding force. The resilient sheet 52, attached near the tip of the friction member 433, greatly helps the friction member 433 to generate enough frictional force between the frictional surface 433*a* and the leading edge of the cut sheet 11 to separate one cut sheet 11 from another. The resilient sheet 52 may be positioned lower to come apart from the friction member 433, allowing for the control of the point of time when the resilient sheet 52 starts contacting and assisting the friction member 433. In such a case, the resilient sheet 52 contacts the friction member 433 nearer to the base end thereof thus generating less rebounding force. The separating characteristics can be thereby finely adjusted.

<Eleventh Embodiment>

Figure 25:
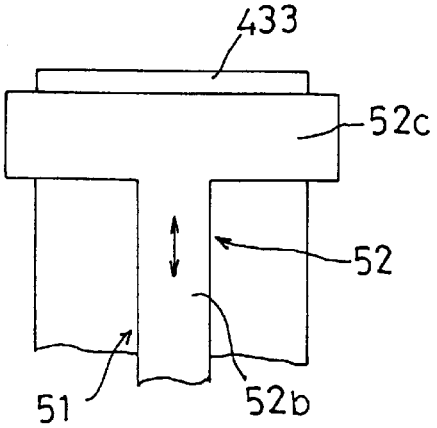
FIG. 25 is a sectional view showing primary parts of an eleventh embodiment of the present invention.

An eleventh embodiment shown in FIG. 25 is substantially the same as the ninth and the tenth embodiments except that the adjusting means 51 comprises the resilient sheet 52 being configured in the form of the letter T, consisting of a narrow tape-like leg portion 52*b* and a pressing portion 52*c* extending to both sides at the tip of the leg portion 52*b*. The height of the resilient sheet 52 is varied to change the position of the pressing portion 52*c* and its contact with the friction member 433 in order to adjust the rebounding force, similarly with the tenth embodiment.

<Twelfth Embodiment>

Figure 26:
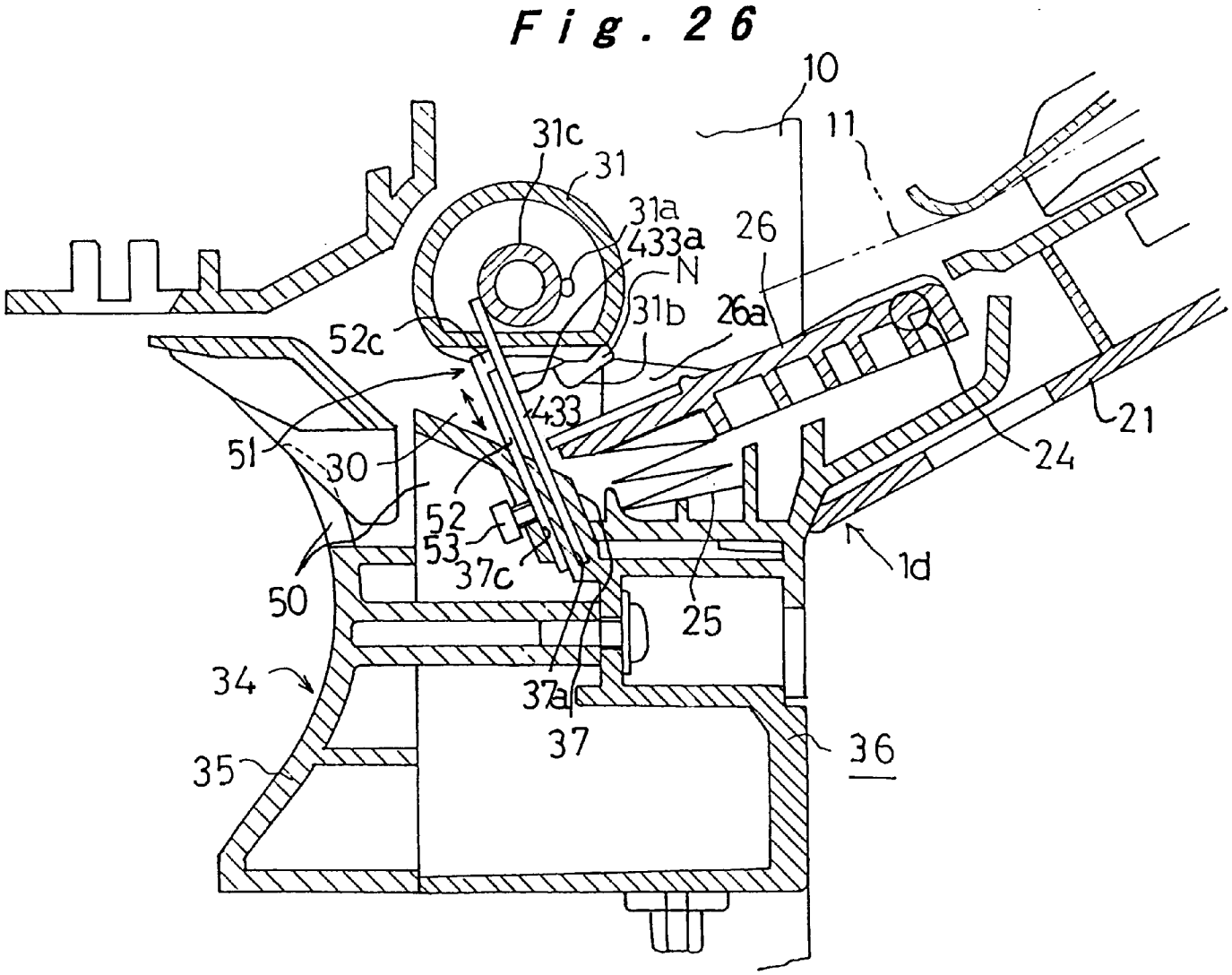
FIG. 26 is a sectional view showing primary parts of a sheet feeder unit according to a twelfth embodiment of the present invention.

In a twelfth embodiment shown in FIG. 26, another slit 37*c* is provided in the support wall 37 behind and at a certain distance from the slit 37*a* for the friction member 433. The resilient sheet 52 is inserted in this slit 37*c* parallel to and separated from the friction member 433 at a certain distance. In addition, a support portion 52*c* is provided to the distal end of the resilient sheet 52 which is contacted with the friction member 433. Similarly with the tenth embodiment, the height of the resilient sheet 52 is adjusted to change the contacting position, thus having the same effects and advantages as those of the previously described embodiments.

<Thirteenth Embodiment>

Figures 27A, 27B:
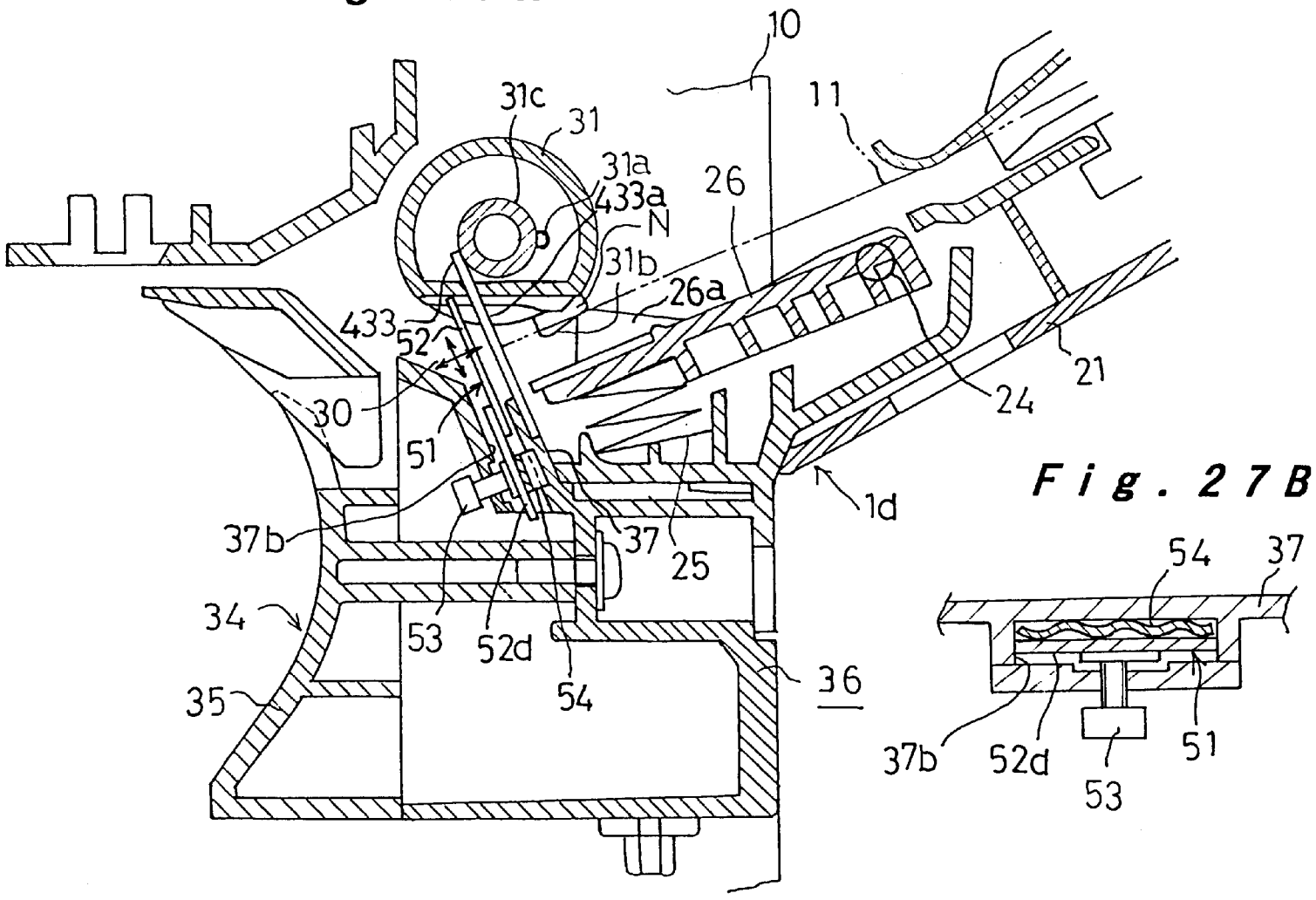
FIGS. 27A and 27B are sectional views showing primary parts of a sheet feeder unit according to a thirteenth embodiment of the present invention.

In a thirteenth embodiment shown in FIG. 27A, the adjusting means 51 is capable of adjusting the height of the resilient sheet 52 disposed parallel to and at a certain distance from the back of the friction member 433 as well as adjusting the distance between the resilient sheet 52 and the friction member 433. For such adjustment, the resilient sheet 52 is mounted to a metal base 52*d* which is urged by a leaf spring 54 within the slit 37*b* toward a direction away from the friction member 433 as shown in FIG. 27A. The base 52*d* is pressed against the force of the spring 54 by the screw 53 bolted from behind the slit 37*b* so that the position of the resilient sheet 52 with respect to the friction member 433 can be adjusted. The height adjustment of the resilient sheet 52 is made by moving the base 52*d* against the frictional force between itself and the leaf spring 54. In order to stably support the base 52*d* with the spring 54 and the screw 53, the spring 54 is configured to be wavy having a multiplicity of undulations in the widthwise direction as shown in FIG. 27B, so as to have an enough pressing force for retaining the base 52*d* in position when vibrated or pressed by external force.

The adjustment of the height of the resilient sheet 52 and the distance between the resilient sheet 52 and the friction member 433 may be also accurately made by other mechanisms using various other means including cams or screws.

Since the resilient sheet 52 is disposed parallel to and distanced from the friction member 433 in this embodiment, it comes into contact with the friction member 433 from the tip thereof only when the friction member 433 is bent to a certain extent, and starts to resiliently warp with the friction member 433 which is further being bent, thus having the same effects as those of the tenth embodiment. The timing when the friction member 433 comes into contact with the tip of the resilient sheet 52 can be determined by adjusting the distance between the resilient sheet 52 and the friction member 433, and the area of contact between the base side of the resilient sheet 52 and the friction member 433 can be adjusted by varying the height of the resilient sheet 52.

The resilient sheet 52 in the ninth to thirteenth embodiments described above may be applied to a friction member made of a rigid material supported around a shaft at its lower end and given a resiling force with a spring, without failing to have the same effects and advantages.

<Fourteenth Embodiment>

Figure 28:
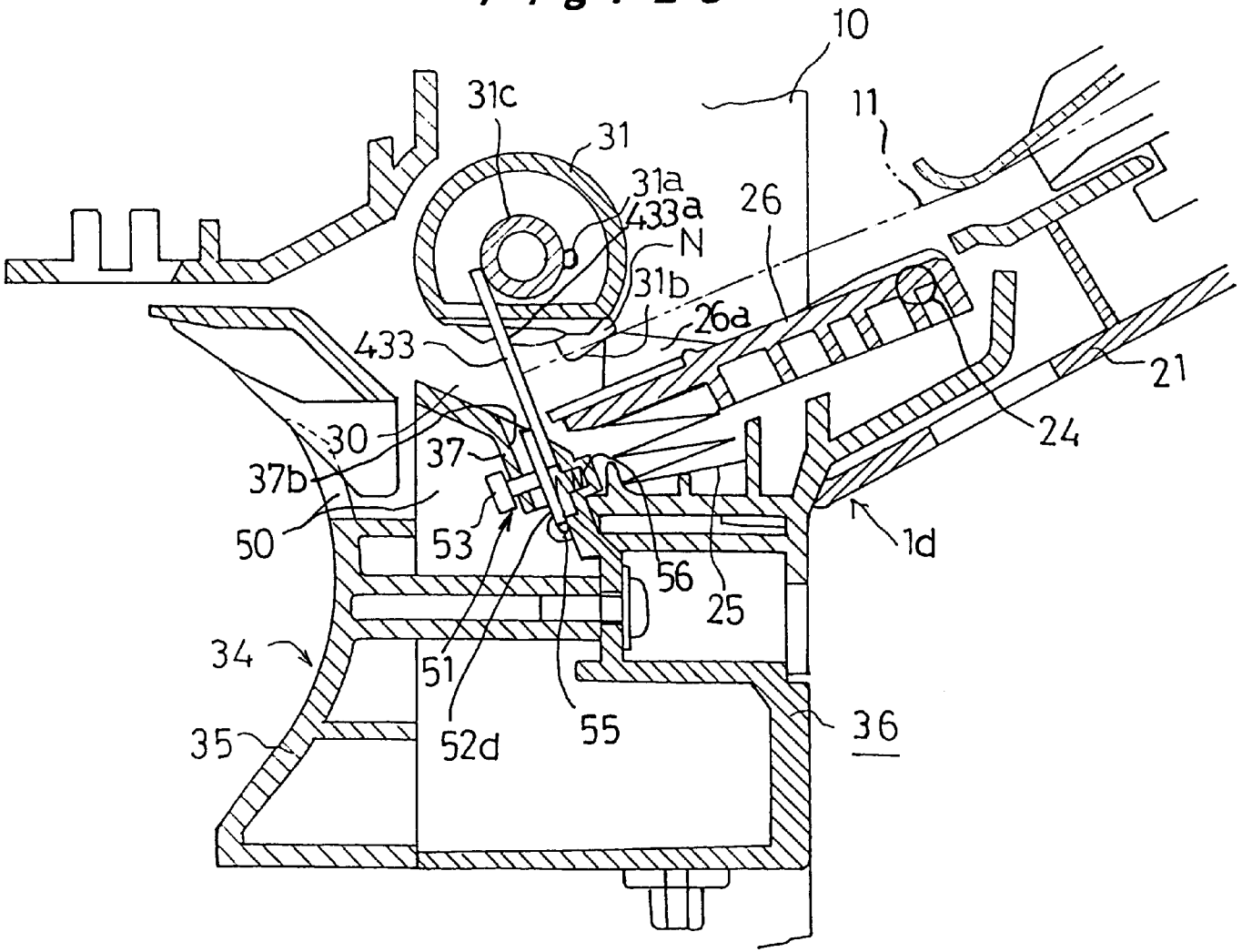
FIG. 28 is a sectional view showing primary parts of a sheet feeder unit according to a fourteenth embodiment of the present invention.

In a fourteenth embodiment shown in FIG. 28, the adjusting means 51 is capable of adjusting the angle of friction member 433 made of a resilient sheet. As shown in FIG. 28, the friction member 433 is mounted to the base 52*d*, which is rotatably supported at its lower end around a shaft 55 within the slit 37*b*. The base 52*d* is urged by a spring 56 toward the downstream side of the sheet feeding direction. The angle of inclination of the friction member 433 around the axis 55 can be adjusted by fixing the base 52*d* at a given position with the screw 53 bolted from behind the slit 37*b*.

When the friction member 433 is greatly inclined, the cut sheet 11 can readily pass over the friction member 433 with little force, whereas the cut sheet 11 receives a greater force from the friction member 433 by setting the angle of inclination closer to vertical. Desired sheet separating characteristics can be thereby obtained.

<Fifteenth Embodiment>

Figure 29:
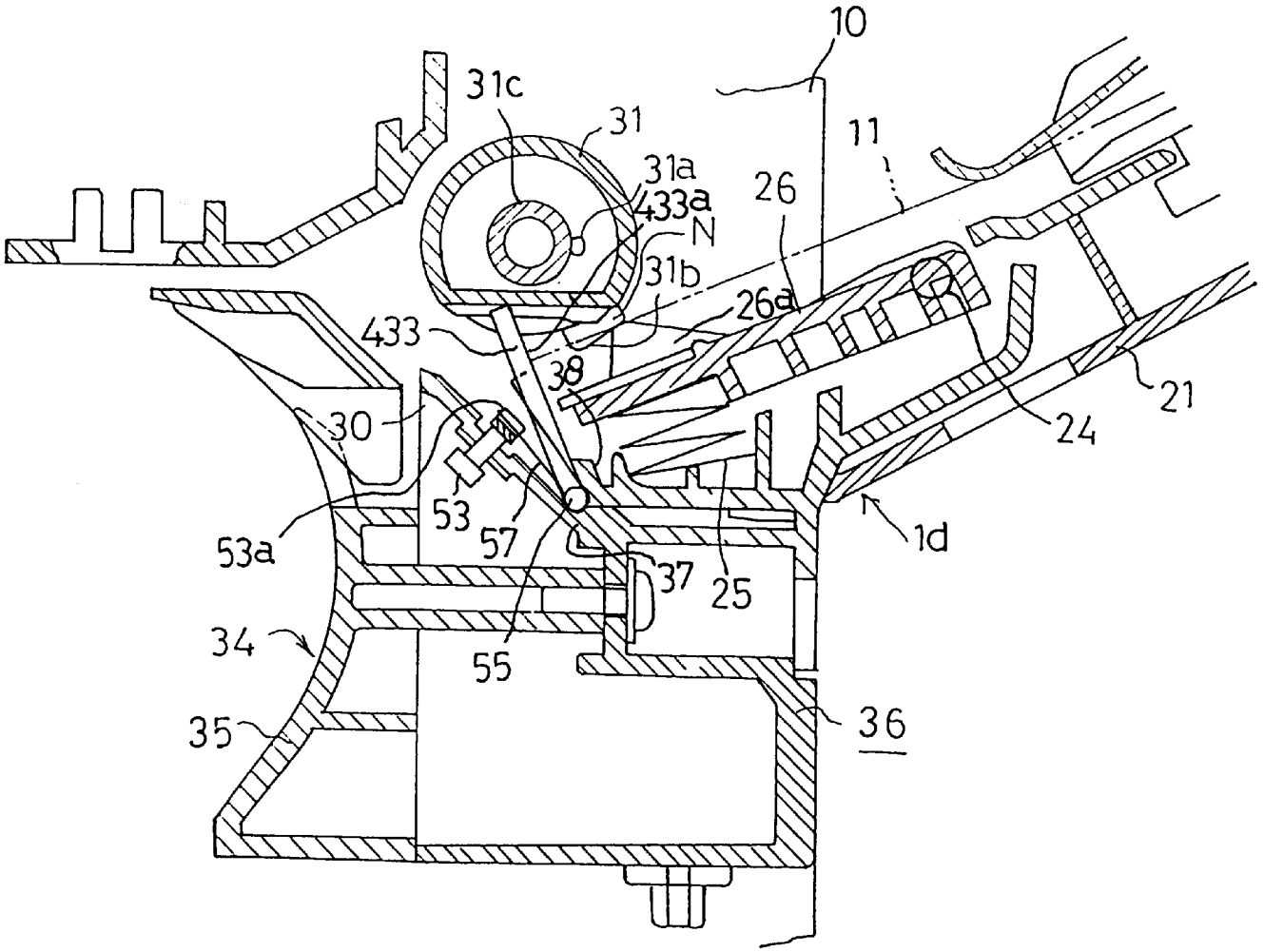
FIG. 29 is a sectional view showing primary parts of a sheet feeder unit according to a fifteenth embodiment of the present invention.
Figure 30:
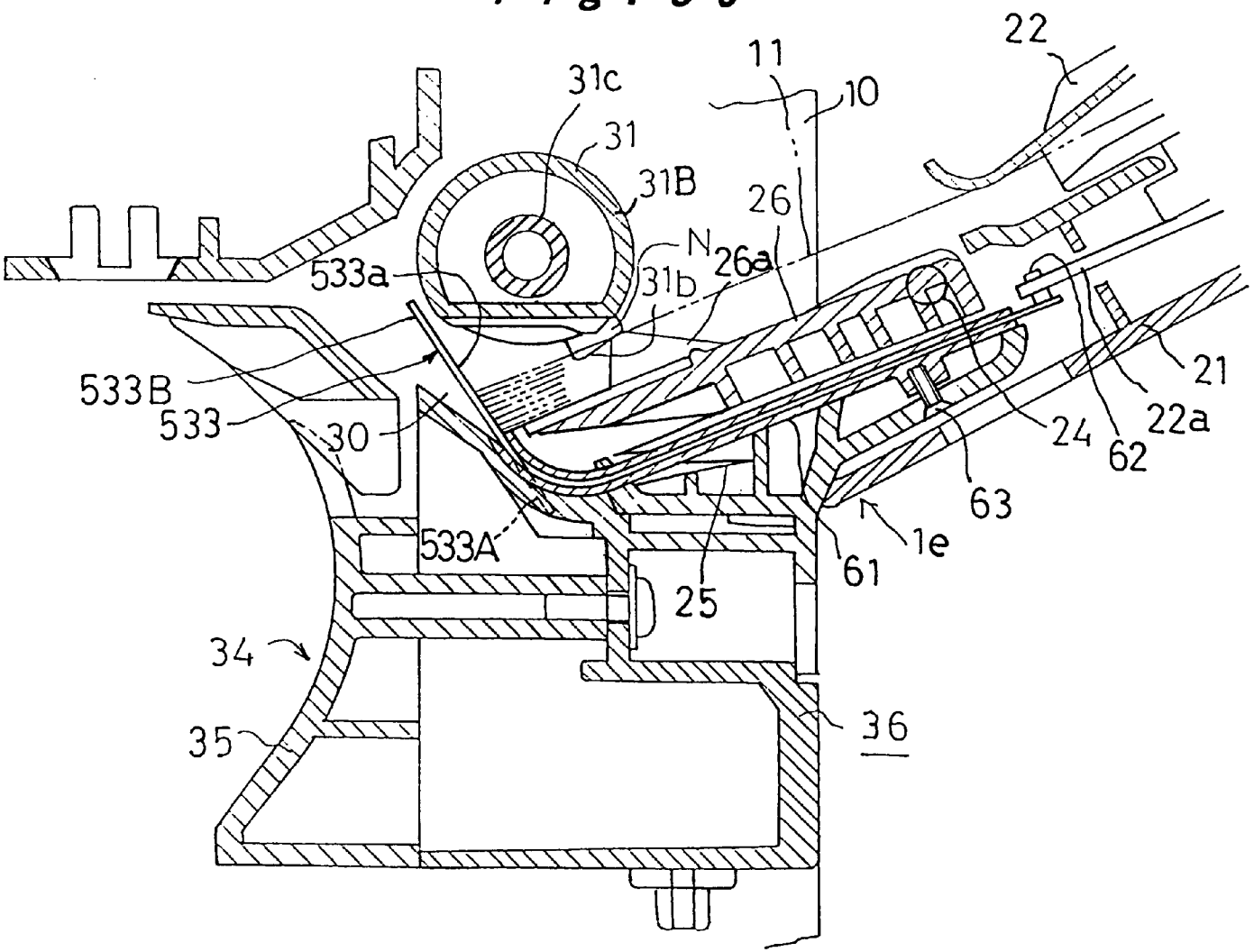
FIG. 30 is a sectional view showing primary parts of a sheet feeder unit according to a sixteenth embodiment of the present invention.

A fifteenth embodiment is shown in FIG. 29, in which the friction member 433 made of a rigid material is lever-like rotatably supported around a shaft 55 at its lower end and given a rebounding force by a spring 57 toward its initial position contacting a stopper 38. One end of the spring 57 is received by a spring holder 53*a* rotatably mounted to the end of the screw 53. The adjusting means 51 adjusts the rebounding force of the friction member 433 provided by the spring 57 by adjusting the screw 53 bolted from the backside of the support wall 37. By this adjustment, various sheet separating characteristics can be defined corresponding to types of cut sheet 11 or ambient conditions.

The adjustment of the resiling force of the friction member in the ninth to fifteenth embodiments described above can be automatically made based on the information on types of paper which is either inputted or automatically detected, or the information on ambient conditions such as humidity which is automatically detected. Such automatic adjustment of the resiling force of the friction member can be readily conducted with an electric actuator.

<Sixteenth Embodiment>

A sixteenth embodiment of the present invention shown in FIGS. 30 to 34 is also implemented as a sheet feeder unit incorporated in a copying machine 10 as shown in FIG. 4 for feeding recording sheets, which is given the reference numeral of 1*e* to be distinguished from the sheet feeder unit of the foregoing embodiments.

The feeding roller 31 of the sheet feeder unit 1*e* disposed in the copying machine 10 comprises a first feeding roller 31A positioned in the middle of the sheet conveying path 30 through which the cut sheets 11 sent out from the feeder cassette 21 pass, and a pair of second feeding rollers 31B arranged symmetrically about the first feeding roller 31A for conveying cut sheets 11 of the size greater than a given regular size. The first feeding roller 31A always comes to a central position of all sizes of cut sheets 11.

Figure 31:
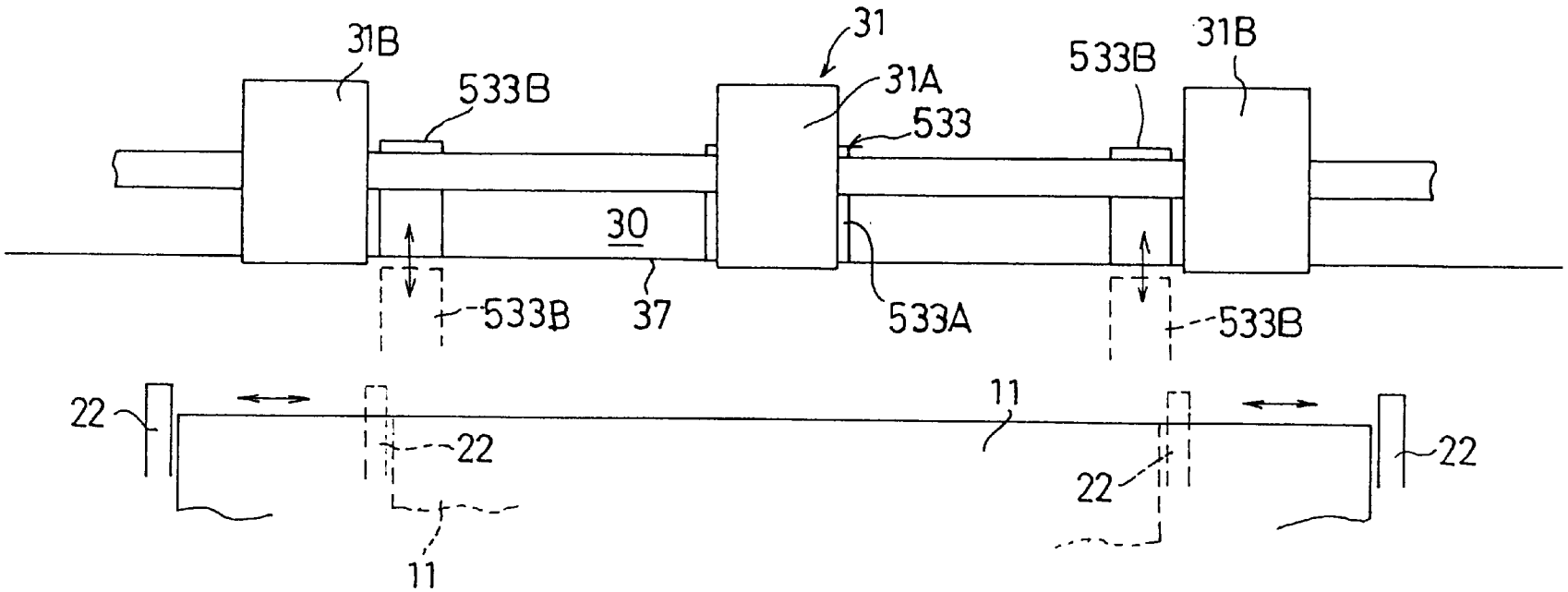
FIG. 31 is a plan view showing primary parts of the sheet feeder unit of FIG. 30.
Figure 32:
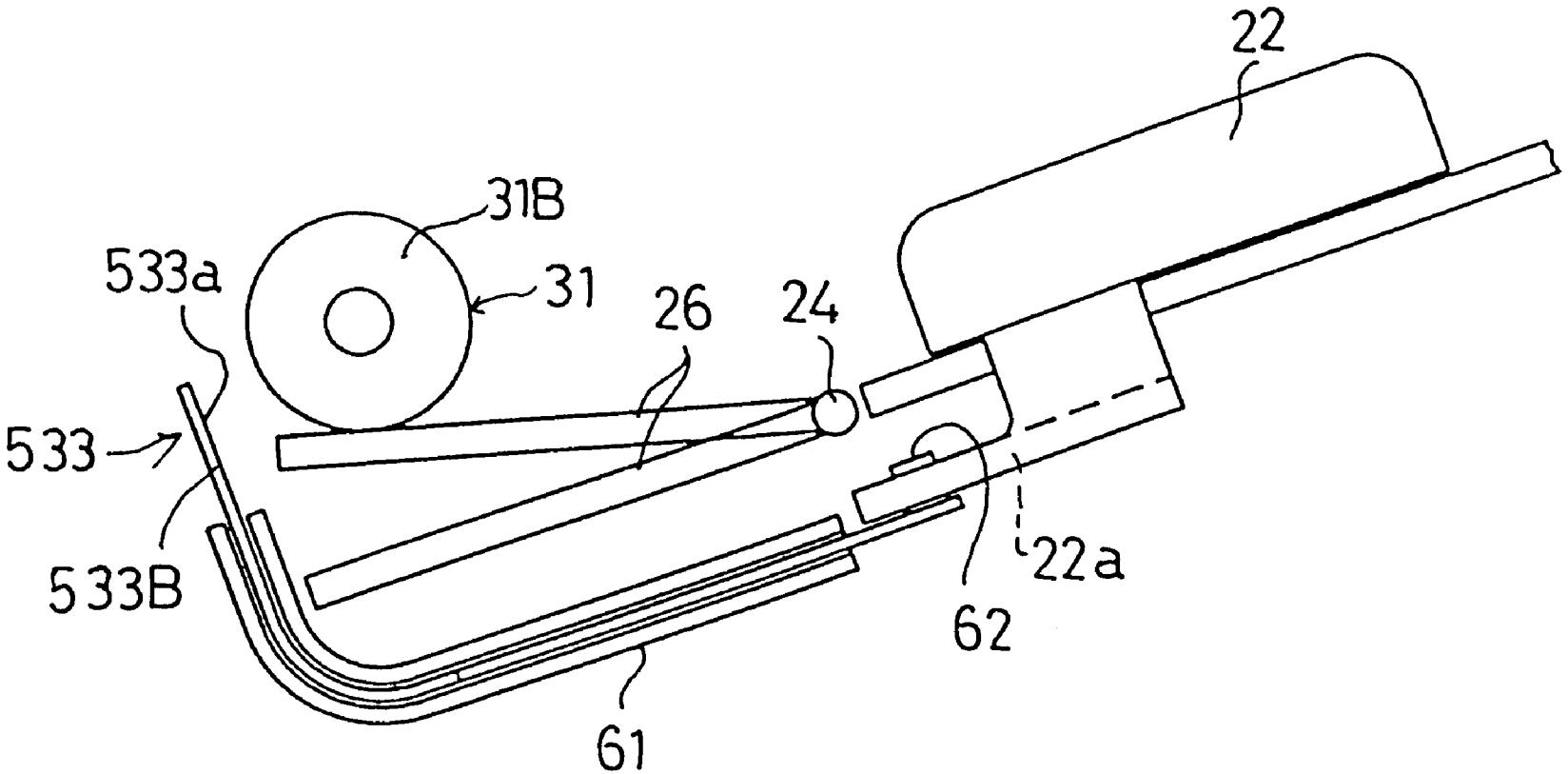
FIG. 32 is a sectional view typically showing a retraction mechanism for a second friction member in the primary parts of the sheet feeder unit of FIG. 30.
Figure 33:
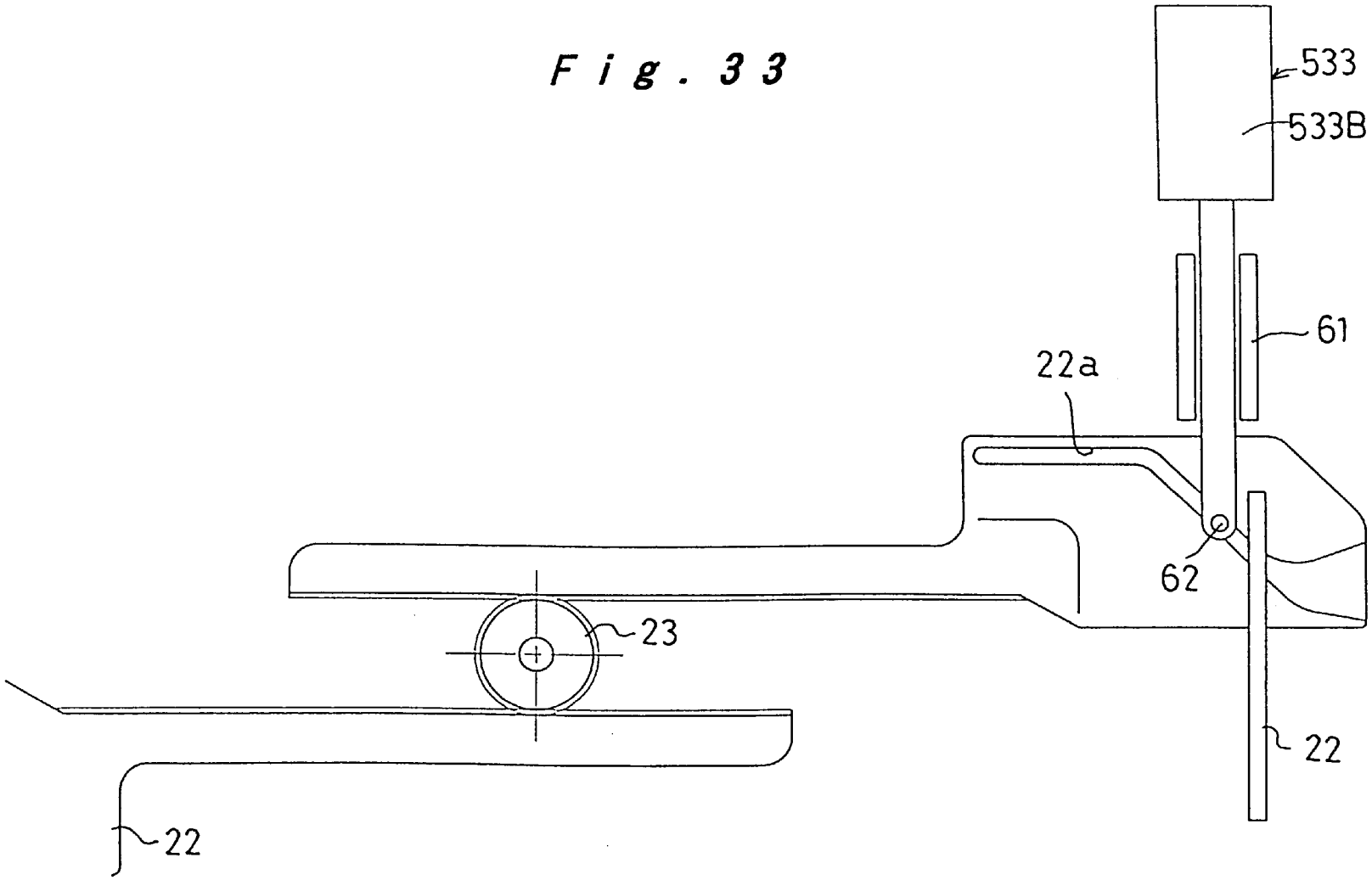
FIG. 33 is a plan view of the retraction mechanism of FIG. 32.
Figure 34:
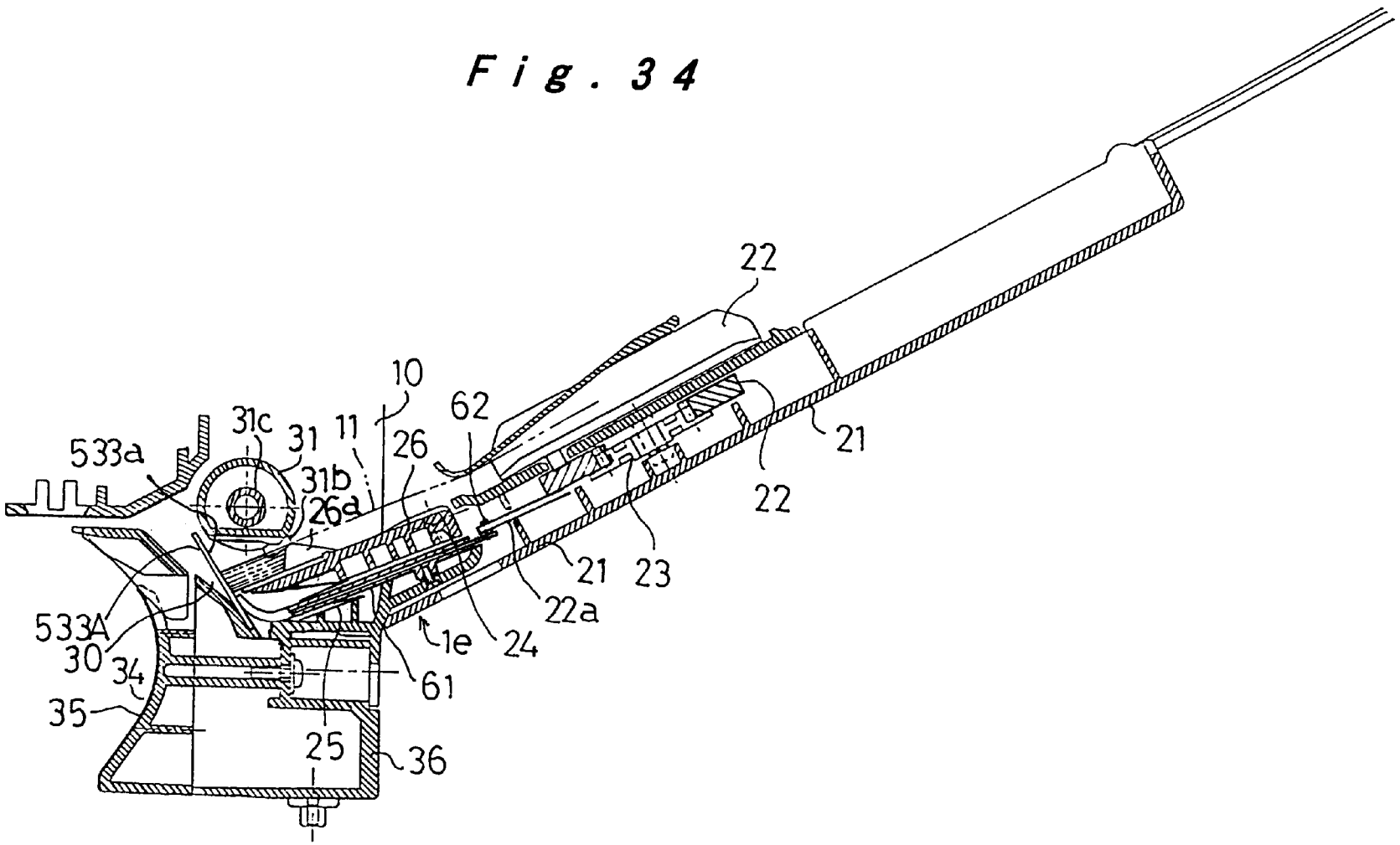
FIG. 34 is a sectional view of an entire body of the sheet feeder unit of FIG. 30.

The friction member 533 comprises a first friction member 533A disposed at the same position of the first feeding roller 31A or close to the same, and second friction members 533B arranged at the same position of the second feeding rollers 31B or close to the same. The first friction member 533A is supported at its lower end being secured to the support wall 37 standing upright under the sheet conveying path 30 by any appropriate means such as bonding or bolting. The second friction members 533B are positioned closer to the center than the second feeding rollers 31B as shown in FIG. 31, and supported in the feeder cassette 21 in such a way that the second friction members 533B can advance to the separating position denoted by a solid line in FIG. 31 and retract therefrom to the retracted position denoted by a broken line by the function of a slide guide 61 shown in FIGS. 30 and 32 to 34. The slide guide 61 is secured to a predetermined position by being bolted to the feeder cassette 21 with a screw 63.

The slide guide 61 is provided with a cam follower 62 which engages with a cam groove 22*a* disposed in the side guide 22 at both sides. When the side guide 22 is moved to a position where it determines the position of the side of the cut sheet of greater size, for example, the position denoted by the solid line in FIG. 31, the second friction members 533B are advanced to the separating position by the function of the cam groove 22*a*. When the side guide 22 is moved to a position where it defines the side of the cut sheet 11 of smaller size as shown by the broken line in FIG. 31, the second friction members 533B are withdrawn to the retracted position. Accordingly, the second friction members 533B come to their separating position to separate the cut sheets 11 only when the cut sheets 11 of the size greater than a given regular size are to be fed.

In this embodiment, the friction member 533 made of a polycarbonate film of about 200 micrometers in thickness is fabricated similarly with the previously described embodiments. Preferably, the angle made between the frictional surface 533*a* and the uppermost cut sheet 1 is set between 90° to 120°. The first and second friction members 533A and 533B fabricated as described above are disposed together with the first and the second feeding rollers 31A and 31B in such an arrangement as described above.

The first feeding roller 31A and the first friction member 533A disposed in the middle between the pair of second feeding rollers 31B and the second friction members 533B is capable of feeding cut sheets of the size smaller than a given normal size one by one, because the sheet conveying force can be evenly applied to the central part of the cut sheets 11. Such settings of the sheet conveying force and the sheet separating characteristics are also applied to cut sheets 11 of larger size. Further, when feeding cut sheets of the size larger than the normal size, the second feeding roller 31B and the second friction members 533B disposed symmetrically on both sides of the first feeding roller 31A provide the necessary sheet conveying force and sheet separating characteristics, which may not be sufficiently provided by the first feeding roller 31A and the friction member 533A. It is thus prevented that sheet conveying force is exceedingly exerted or unequally applied, causing the cut sheet 11 to be fed obliquely. Accordingly, such arrangement of the feeding rollers and friction members allows the sheet feeder unit to have a stable sheet feeding performance irrespective of sizes of the cut sheet.

If the second friction members 533B were positioned far from the center of the cut sheet 11, they would tend to obstruct the advancing action of the cut sheet 11. For that reason, each second friction member 533B is disposed at the inner side of each second feeding roller 31B. In other words, the second friction members 533B are symmetrically positioned within the range where the cut sheet is forcibly sent out by the pair of second feeding rollers 31B and the first feeding roller 31A in the middle, allowing the cut sheet 11 to positively advance, pushing back the second friction members 533B. The sheet feeding performance is thereby further enhanced, as it is prevented that the cut sheets are stopped or fed obliquely in case the friction members are positioned far away from the center. Since the second friction members 533B are not disposed directly under each second feeding roller 31B but inwardly shifted therefrom, the second friction members 533B provide less sheet feeding capacity as compared to the first friction member 31A. In addition to this, the width of each second friction member 533B is set to be smaller while the material, thickness, length, and disposing conditions are set identical to those of the first friction member 533A in this embodiment, so as to prevent the sheet separating characteristics from exceeding the desired level. Such adjustment can be variously made by setting various parameters including conditions of the frictional surface 533*a*.

When the cut sheet 11 pushed out by the feeding rollers 31 is smaller than a given size passing through inside the second feeding rollers 31B, the second friction members 533B positioned at the inner side of the second feeding rollers 31B are automatically withdrawn from the sheet conveying path 30 by the function of the cam groove 22*a* and the cam follower 62, as the side guide 22 is moved to determine the position of the side of the cut sheet 11. It is thus prevented that the sheet feeding characteristics exceed the desired level when smaller cut sheets are fed.

When the side guide 22 is moved to a position which defines the position of the side of the cut sheet 11 as being larger than a given size, the second friction members 533B are advanced to the separating position via the cam groove 22*a* and the cam follower 62, so as to effect the separation of cut sheets one by one.

The means for causing the second friction members 533B to retract is preferably constructed to link with the movement of the side guide 22, as such structure is simple while acting reliably. The construction of the retraction means is of course not limited to such mechanism, and the second friction member 533B may be electrically actuated to advance and retract based on the detection signals obtained by electrically detecting the position of the side guide 22.

Although the embodiment has been described as a centering type sheet feeder, the entire structure of the embodiment may be applied to the sheet feeder which aligns the cut sheets thereon at one side, because a plurality of feeding rollers 31 prevents the cut sheet 11 from being fed obliquely. In either case, at least one of the first feeding roller 31A and the first friction member 533A may be also provided in plurality.

If the cut sheets 11 are aligned on one side of the feeder tray, the first feeding roller 31A and the first friction member 533A may be disposed at a common position where cut sheets 11 of all sizes pass and only one of the second feeding roller 31B and the second friction member 533B may be provided at a position where cut sheets 11 of larger size pass, in order to perform stable sheet feeding for all sizes of cut sheets 11. Also, the friction member 533 may not necessarily be made of a resilient sheet, and may be made of a rigid material and axially supported at its end with a spring providing a resiling force.

<Seventeenth Embodiment>

Figure 35:
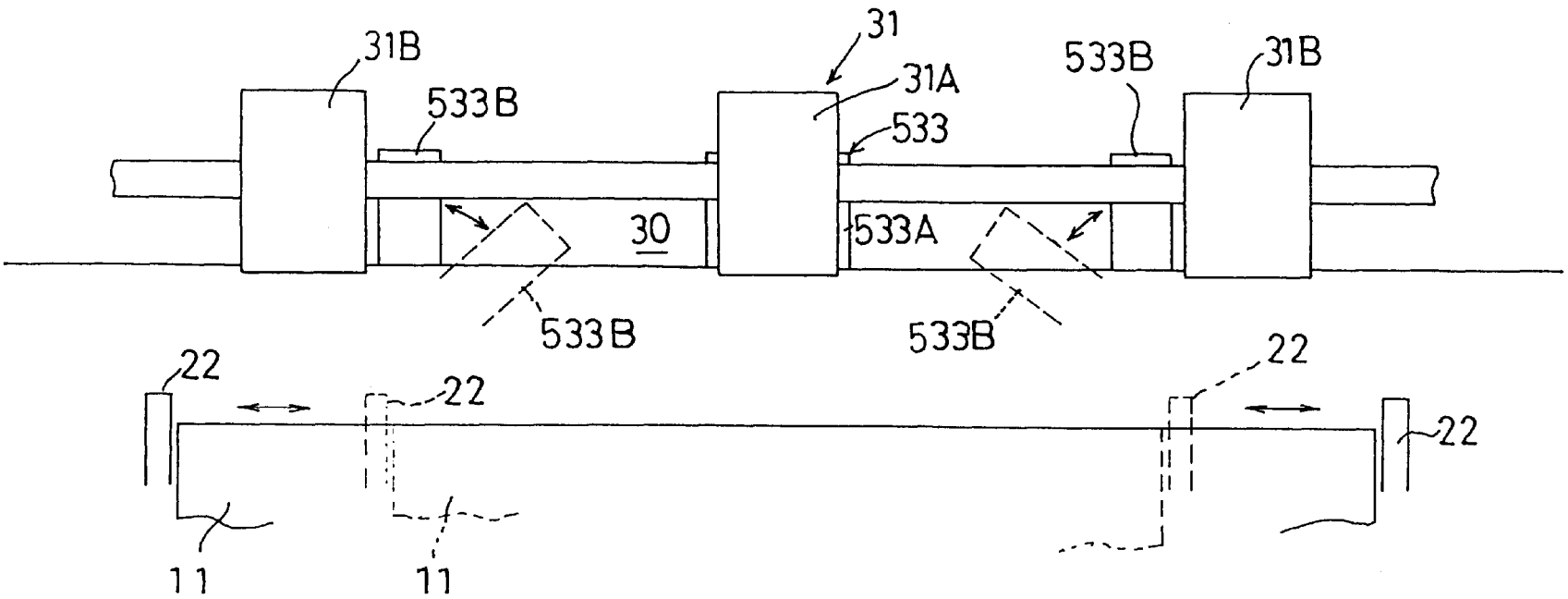
FIG. 35 is a plan view showing primary parts of a seventeenth embodiment of the present invention.

In a seventeenth embodiment shown in FIG. 35, the second friction member 533B are arranged to tilt laterally between the separating position denoted by a solid line and the retracting position withdrawn from the sheet conveying path 30 as denoted by a broken line. The movement of the second friction members 533B is linked with the movement of the side guide 22 between the position which defines the side of the cut sheets being greater than a normal size (solid line) and the position which defines the side of the cut sheets being smaller than the normal size (broken line). This embodiment differs from the sixteenth embodiment only in the direction of retracting movement of the friction members 533B, and has the same effects and advantages as those of the sixteenth embodiment.

Description of a specific linking means in this embodiment will be thus omitted. The second friction members 533B may also be retracted from the conveying path 30 by tilting the same along the sheet feeding direction. Method and means for causing the friction member to retract from the conveying path 30 are not limited to specific ones described herein.

<Eighteenth Embodiment>

Figure 36:
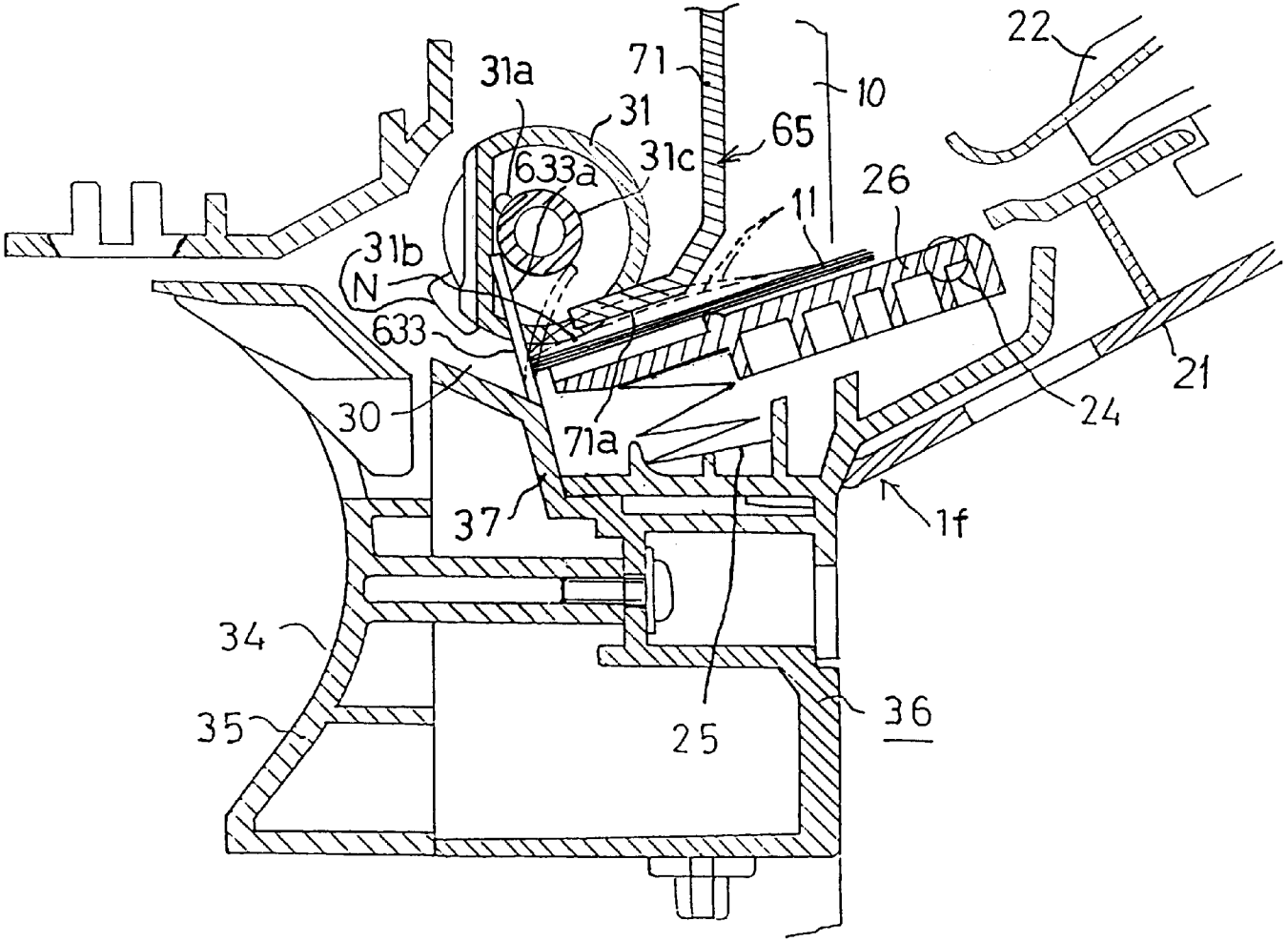
FIG. 36 is a sectional view showing primary parts of a sheet feeder unit according to an eighteenth embodiment of the present invention.
Figure 37A:
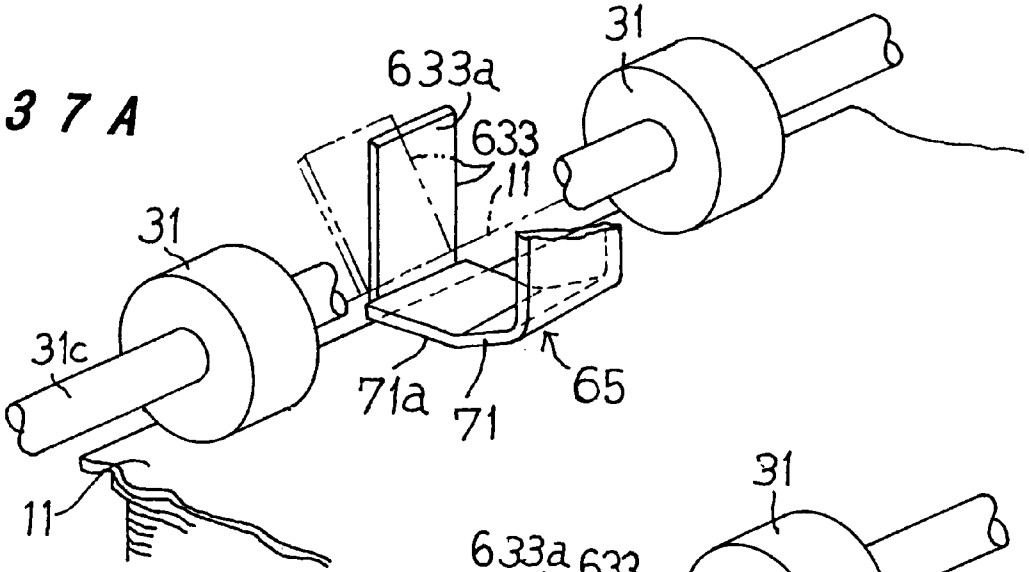
FIGS. 37A and 37B are perspective views showing the primary parts of the sheet feeder unit of FIG. 36 with and without the control member in comparison with each other.
Figure 37B:
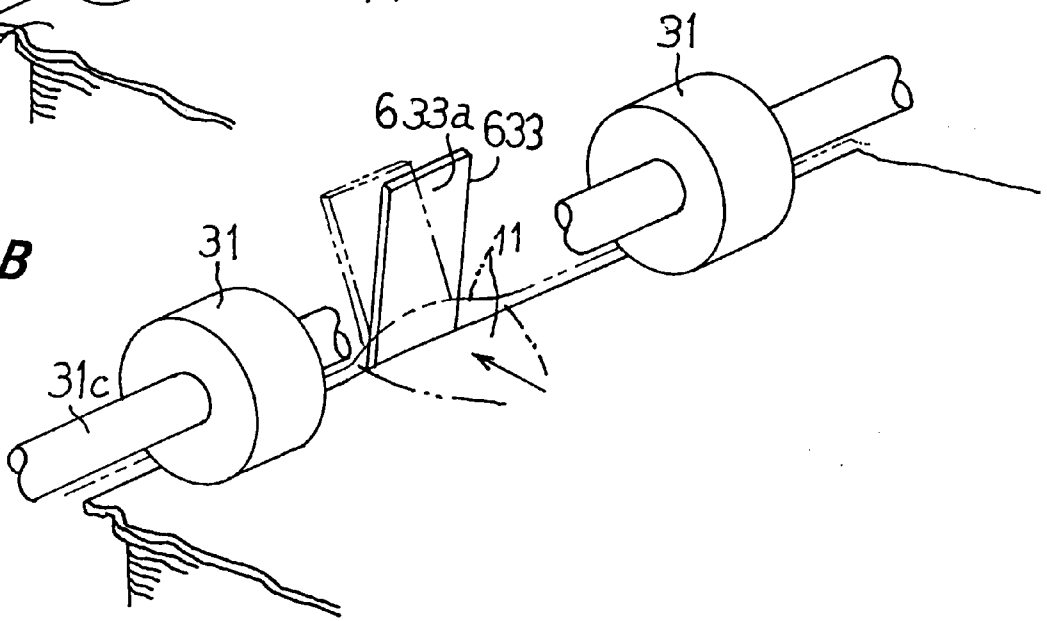
Figure 38:
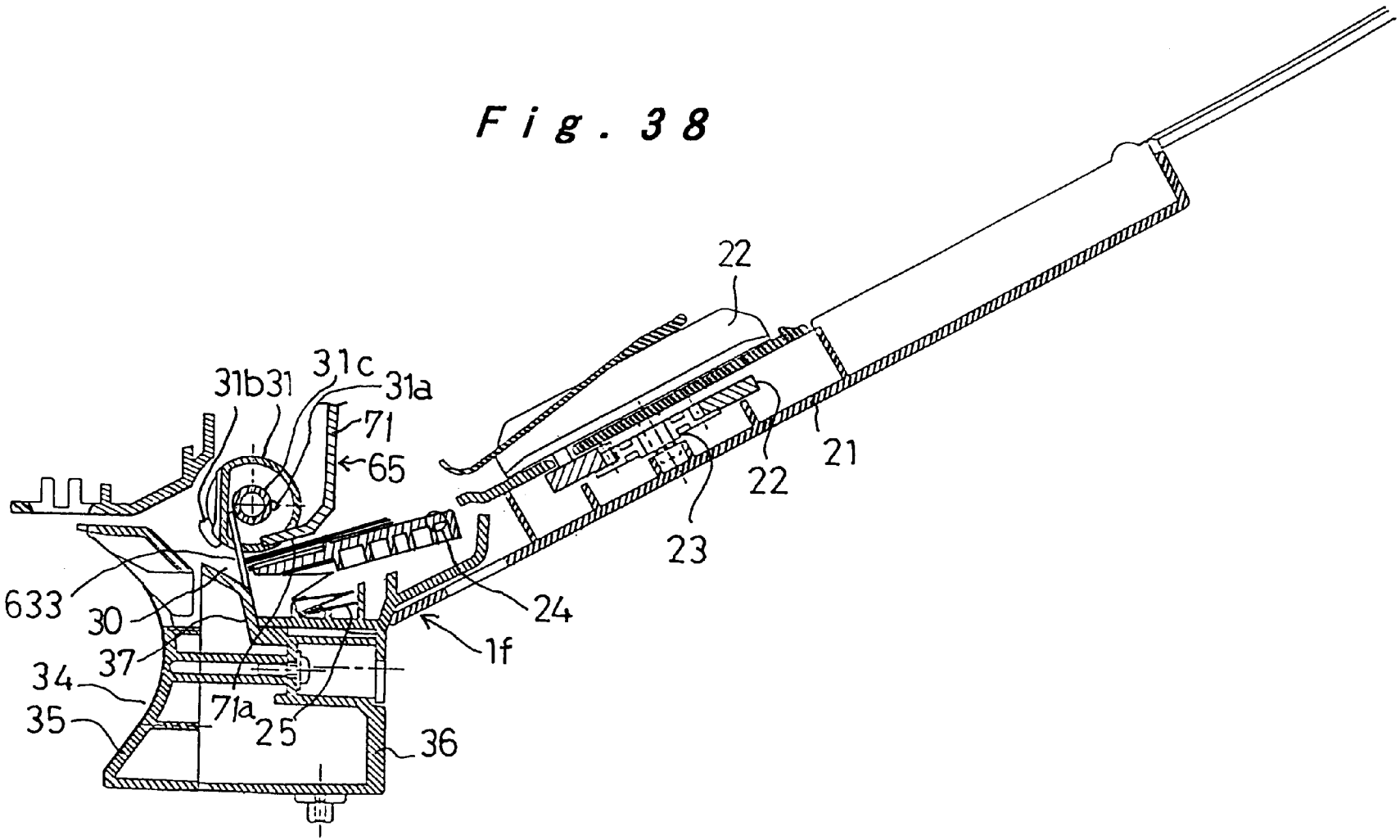
FIG. 38 is a sectional view of an entire body of the sheet feeder unit of FIG. 36.

An eighteenth embodiment of the present invention shown in FIGS. 36 to 38 is also implemented as a sheet feeder unit incorporated in a copying machine 10 as shown in FIG. 4 for feeding recording sheets, which is given the reference numeral of if to be distinguished from the sheet feeder unit of the foregoing embodiments.

In this embodiment, the friction member 633 made of a polycarbonate film of about 200 micrometers in thickness is fabricated similarly with the previously described embodiments. Preferably, the angle made between the frictional surface 633*a* and the uppermost cut sheet 11 is set between 90° to 120°. The friction member 633 is disposed at a certain distance from the feeding roller 31, and a restriction member 65 is mounted at the upstream side of the sheet feeding direction above the cut sheet 11 for limiting the upward deformation of the cut sheet 11.

Even if the leading edge of the cut sheet 11 is downwardly curled as shown by a phantom line in FIG. 36, the restriction member 65 presses the sheet to rectify its curve as denoted by a broken line, thereby causing the cut sheet 11 to advance straight toward the friction member 633. Similarly, even when the leading edge of the cut sheet 11 may be partly bulged as denoted by a phantom line in FIG. 37B caused by the resistance generated when the cut sheet proceeds toward the frictional surface 633*a*, the restriction member 65 opposed to the leading edge of the cut sheet 11 from above in the vicinity of the upstream side of the sheet feeding direction presses down the cut sheet effectively as shown by the broken line in FIG. 36 to allow the cut sheet 11 to advance toward the friction member 633 smoothly at a predetermined angle. Cut sheets of many types can thereby be separated from each other without any residual deformation and fed stably.

Specifically in the eighteenth embodiment, the friction member 633 is disposed substantially in the middle between a pair of feeding rollers distanced from each other. The uppermost cut sheet 11 can be pushed straight out by the two feeding rollers 31 proportionally and evenly exerting the sheet conveying force, while the friction member 633 positioned in the middle provides a desired amount of frictional force.

The arrangement of this embodiment may also be applied to a sheet feeder which aligns cut sheets at one side thereof, as the cut sheets can be straightly conveyed due to the provision of a pair of feeding rollers 31. Further, an additional feeding roller may be provided or a pair of friction members may be mounted on both sides of one feeding roller. It is anyway advantageous to provide such a restriction member as described above. In case the friction member 633 is configured to contact the whole width of the cut sheet 11, the restriction member 65 is preferably provided across the entire width of the friction member 633 except where there are the feeding rollers 31, or is disposed in plurality.

The restriction member 65 comprises a pad 71 made of a plate having a smooth surface 71*a* facing the cut sheet 11. Such pad 71 is compact and can be flexibly mounted as shown in FIG. 36 corresponding to needs, thus being able to be placed even between the rotation shaft 31*c* of the feeding roller 31 and the cut sheet 11 which are close to each other. The smooth surface 71*a* is positioned higher than the nipping position N where the feeding roller 31 contacts the cut sheet 11, thus limiting or rectifying the deformation of the cut sheet only when the cut sheet 11 is curled up or bulged. Otherwise, the pad 71 does not apply any external force to the cut sheet 11.

<Nineteenth Embodiment>

Figure 39:
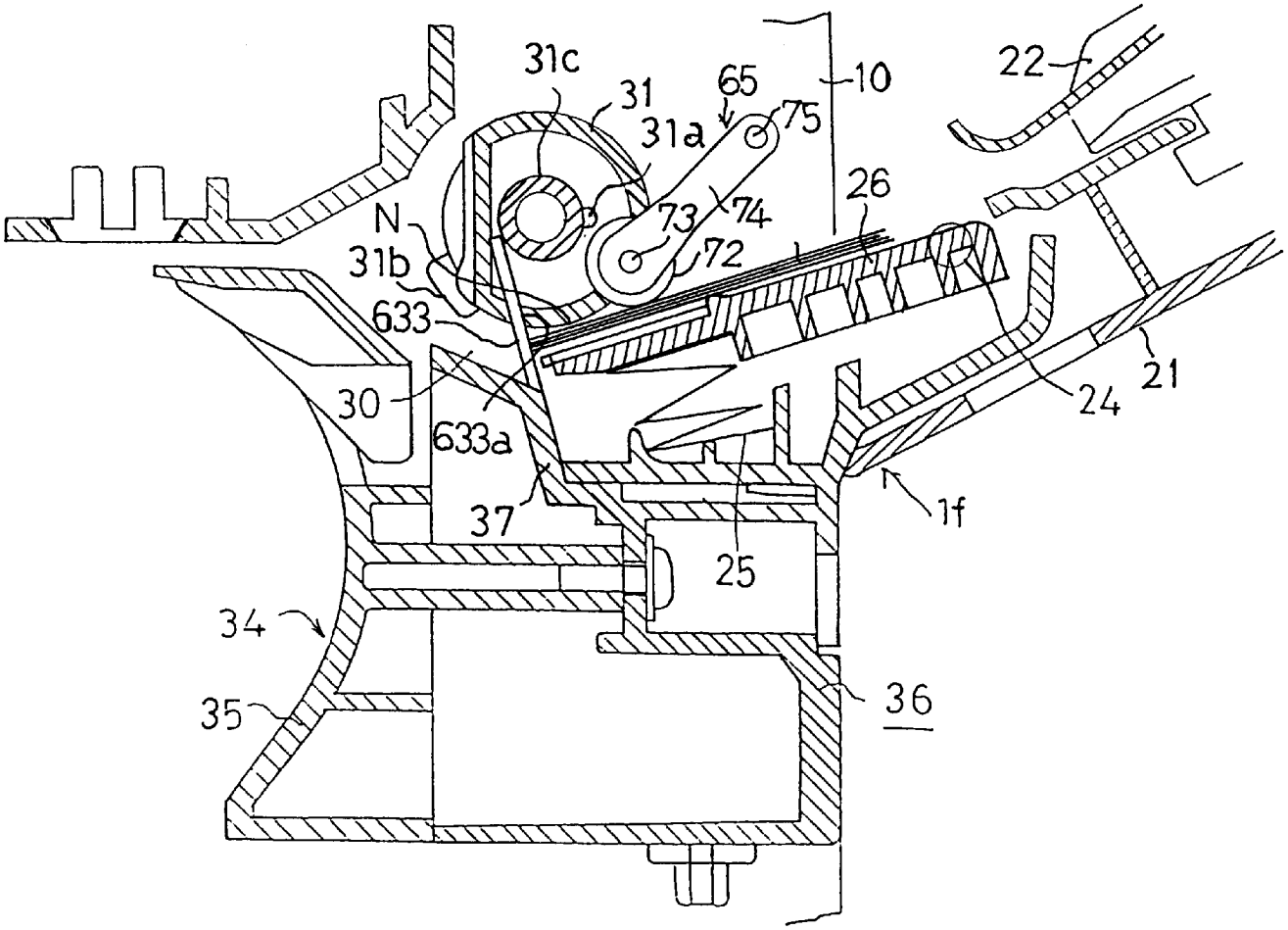
FIG. 39 is a sectional view showing primary parts of a sheet feeder unit according to a nineteenth embodiment of the present invention.

In a nineteenth embodiment shown in FIG. 39, the restriction member 65 is comprised of a roller 72 having a smaller outside dimension than the feeding roller 31. The roller 72 is rotatably supported by a shaft 73 at the distal end of a lever 74, which is pivotally supported at its base end by a shaft 75 within the copying machine 10.

Since the roller 72 is small and compact, it can be mounted very close to the friction member 633 without adversely affecting the movement of the rotating shaft 31*c* of the feeding roller 31. The roller 72 is supported to be freely rotatable and to run idly when contacting to the cut sheet 11, thus causing no adverse effects or damage to the cut sheet 11. As it presents no problems if the roller 72 is lightly pressed against the cut sheet 11 from above, the roller may be supported by the lever in such a way that the roller 72 is brought to contact with the cut sheet 11 by its own weight, whereby the functions of rectifying the deformation or bulge of the cut sheet 11 can be further enhanced. It is also possible to lightly urge the lever 74 to cause the roller 72 to be pressed against the cut sheet 11.

Other parts and effects are identical to those of the eighteenth embodiment, and like parts are given the same reference numerals, of which illustration and description will be omitted.

The present invention has been described with respect to a sheet feeder unit which feeds sheets from the top side, but it is of course possible to apply the present invention to a sheet feeder unit sending out sheets from the bottom side.

It is also possible to variously combine any of these embodiments from 1 to 19, or to apply one arrangement to another.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet feeder unit comprising:

a support member on which a pile of sheets can be loaded;

a feeding roller having a nipping position for contacting one face of a pile of sheets when piled on the support member and for sending out the sheets in a sheet feeding direction, the feeding roller being supported around a shaft and having a void portion along the shaft where the feeding roller does not contact with the sheets, the shaft being positioned downstream, in a sheet feeding direction, from said nipping position of the feeding roller; and a friction member supported at one end thereof, the other end of which extends into the void portion of the feeding roller and is able to contact with a leading edge of the sheets within a range defined by an outside dimension of the feeding roller.

2. A sheet feeder unit according to claim 1, wherein the friction member is made of a material which is capable of resilient deformation.

3. A sheet feeder unit according to claim 1, wherein the friction member is rotatably supported at one end thereof, and the other end of the friction member is urged toward the leading edge of the sheets by a force yielding member.

4. A sheet feeder unit according to claim 1, wherein a surface of the friction member for contacting a leading edge of the sheets has a substantially flat configuration.

5. A sheet feeder unit according to claim 1, wherein the void portion of the feeding roller is formed around a rotation center of the feeding roller, and the friction member is capable of extending to a position beyond the rotation center of the feeding roller.

6. A sheet feeder unit according to claim 5, wherein an angle made between a surface of the friction member which contacts a leading edge of the sheets and one face of the sheets contacted by the feeding roller is within a range from 90 to 120 degrees.

7. A sheet feeder unit according to claim 1, wherein a static frictional coefficient on a surface of the friction member which contacts a leading edge of the sheets is approximately 1.0 to 1.5 with respect to the sheets.

8. A sheet feeder unit according to claim 1, wherein the feeding roller rotates about a rotation center and the friction member is positioned in a plane that includes the rotation center of the feeding roller when the leading edge of the sheets comes into frictional contact with the friction member.

9. A sheet feeder unit according to claim 1, further comprising:

a boss provided on the shaft for contacting a tip of the friction member when a sheet feeding operation is started.

10. A sheet feeder unit according to claim 9, wherein the boss contacts the friction member when a first portion of the feeding roller is positioned at a first location with respect to an uppermost sheet when the sheet feeding operation is started.

11. A sheet feeder unit according to claim 9, wherein the boss is capable of contacting the friction member when a first portion of the feeding roller is positioned within a given range around a first location with respect to an uppermost sheet when the sheet feeing operation is started.

12. A sheet feeder unit according to claim 9, wherein the boss is a crank which retracts from contacting the friction member before the sheet feeding operation is completed for a single sheet.

13. A sheet feeder unit according to claim 1, wherein a plurality of friction members, including said friction member is provided, each of which is arranged to contact a leading edge of the sheets at a different angle.

14. A sheet feeder unit according to claim 13, wherein one of said plurality of friction members is centrally positioned and is arranged to contact with a leading edge of the sheets at a wider angle than another friction member of said plurality of friction members.

15. A sheet feeder unit according to claim 13, wherein a height of each friction member and a contacting angle between a respective friction member and a leading edge of the sheets correspondingly decrease.

16. A sheet feeder unit according to claim 1, wherein a surface of the friction member for frictionally contacting a leading edge of the sheets increases in width along a sheet feeding direction.

17. A sheet feeder unit according to claim 16, wherein the friction member is made of a resilient sheet which is configured to increase in width from a middle part toward a distal end thereof and to have edges from the middle part to the distal end turned upwardly.

18. A sheet feeder unit according to claim 1, further comprising an adjusting means for adjusting a rebounding force of the friction member which can be deformed by contact with the sheets.

19. A sheet feeder unit according to claim 1, wherein the support member is capable of holding sheets of different sizes thereon aligned with each other at a center of the sheets in a widthwise direction, and the feeding roller and the friction member are a first feeding roller and a first friction member, respectively, both of which are disposed at positions to be able to contact sheets of all sizes which can be loaded on the support member, the sheer feeder unit further comprising:

a pair of second feeding rollers for contacting sheets having a width that is greater than a given width, said pair of second feeding rollers being disposed at symmetrical positions in a width-wise direction with respect to the center of the sheets when piled on the support member; and a pair of second friction members for contacting sheets having a width that is greater than a given width, said second pair of friction members being disposed at symmetrical positions in a widthwise direction with respect to the center of the sheets when piled on the support member.

20. A sheet feeder unit according to claim 19, wherein the pair of second friction members is disposed inside the pair of second feeding rollers.

21. A sheet feeder unit according to claim 20, further comprising a means for causing the pair of second friction members to retract when the sheets piled on the support member have a shorter width than the distance between the pair of second feeding rollers.

22. A sheet feeder unit comprising:

a support member on which a pile of sheets are loaded;

a feeding roller for contacting one face of a pile of sheets when piled on the support member and for sending out the sheets in a sheet feeding direction;

a friction member having one end positioned at a leading edge side of the sheets and another end which is supported such that the friction member can contact a leading edge of the sheets within a range defined by an outside dimension of the feeding roller, the friction member having a frictional surface for providing frictional contact with the sheets; and a restriction member disposed upstream, in said sheet feeding direction, with respect to the friction member, as well as at a side of the sheets where the feeding roller contacts with the sheets.

23. A sheet feeder unit according to claim 22, wherein the feeding roller comprises a pair of rollers supported around a common shaft, and the friction member and the restriction member are disposed along a center line between the pair of rollers.

24. A sheet feeder unit according to claim 22, wherein the feeding roller is supported around a shaft and has a void portion in the axial direction of the shaft where the feeding roller does not contact the sheets, and the friction member extends into the void portion of the feeding roller.

25. A sheet feeder unit according to claim 24, wherein the restriction member includes a restriction roller having a smaller outside dimension than that of the feeding roller.

26. A sheet feeder unit according to claim 22, wherein the restriction member comprises a pad provided with a slip surface on a surface for contacting the sheets, the slip surface being positioned higher than a nipping position where the feeding roller can contact the sheets.

27. A sheet feeder unit comprising:

a support member on which a pile of sheets can be loaded;

a feeding roller for contacting an uppermost face of the sheets when piled on the support member and for sending out the sheets in a sheet feeding direction; and a plurality of friction members positioned along a leading edge side of the sheets, each frictional member having a frictional surface disposed at a different inclination angle along a direction of frictional contact with the sheets.

28. A sheet feeder unit according to claim 27, wherein a frictional surface of a friction member has a curved configuration.

29. A sheet feeder unit according to claim 27, wherein a frictional surface of a friction member has a wavy configuration.

30. A sheet feeder unit according to claim 27, wherein the feeding roller comprises a pair of rollers supported around a common shaft, and a friction member is disposed along a center line between the pair of rollers.

31. A sheet feeder unit according to claim 30, wherein a frictional surface of a friction member is configured such that a central portion thereof in a widthwise direction extends upstream in a sheet feeding direction.

* * * * *

UNITED STATES PATENT AND TRADEMARK OFFICE
CERTIFICATE OF CORRECTION

PATENT NO : 6,086,062
DATED : July 11, 2000
INVENTOR(S) : Yasuo Nakamura et al.

It is certified that error appears in the above-identified patent and that said Letters Patent are hereby corrected as shown below:

On the Front Page [75] Inventors:, the first line, delete "Toyokawa", and insert --Toyokawa-Shi--.

On the Front Page [75] Inventors:, the second line, delete "Okazaki", and insert --Okazaki-Shi--.

Column 21, line 41 (claim 11, line 5), delete "feeing", and insert --feeding--.

Column 22, line 12 (claim 19, line 8), delete "sheer", and insert --sheet--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*